US008500254B2

(12) United States Patent
Ishibe et al.

(10) Patent No.: US 8,500,254 B2
(45) Date of Patent: Aug. 6, 2013

(54) LIQUID SUPPLY APPARATUS AND LIQUID-CONSUMING APPARATUS FOR ENSURING COMPLETE INK CARTRIDGE ATTACHMENT

(75) Inventors: Akinari Ishibe, Toyohashi (JP); Hiroaki Yazawa, Nagoya (JP); Hirotake Nakamura, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 270 days.

(21) Appl. No.: 12/892,440

(22) Filed: Sep. 28, 2010

(65) Prior Publication Data

US 2011/0096127 A1 Apr. 28, 2011

(30) Foreign Application Priority Data

Oct. 23, 2009 (JP) ..... 2009-244105

(51) Int. Cl.
*B41J 2/175* (2006.01)

(52) U.S. Cl.
USPC ..... 347/84; 347/86

(58) Field of Classification Search
USPC ..... 347/84, 37
See application file for complete search history.

(56) References Cited

U.S. PATENT DOCUMENTS

| | | | | |
|---|---|---|---|---|
| 6,520,619 | B1 * | 2/2003 | Murcia et al. | 347/32 |
| 8,042,909 | B2 * | 10/2011 | Sakai et al. | 347/86 |
| 2005/0168545 | A1 | 8/2005 | Sakai et al. | |
| 2008/0136879 | A1 | 6/2008 | Sakai et al. | |
| 2008/0291252 | A1 | 11/2008 | Sakai et al. | |
| 2009/0135237 | A1 * | 5/2009 | Nakamura et al. | 347/86 |
| 2009/0256884 | A1 * | 10/2009 | Aoki | 347/23 |

FOREIGN PATENT DOCUMENTS

| | | | |
|---|---|---|---|
| JP | 2002254670 | A * | 9/2002 |
| JP | 2005-67168 | | 3/2005 |
| JP | 2005/074979 | | 3/2005 |
| JP | 2005/254794 | | 9/2005 |
| JP | 2007050527 | A * | 3/2007 |
| JP | 2008/188948 | | 8/2008 |
| JP | 2009/131971 | | 6/2009 |
| JP | 2009-132098 | | 6/2009 |

OTHER PUBLICATIONS

Machine generated English translation of specificatio of JP2007-050527A to Takagi, "Inkjet Printer Apparatus"; generated via http://www19.ipdl.inpit.go.jp/PA1/cgi-bin/PA1INDEX on Nov. 13, 2012, 6 pp.*

Notice of Reasons for Rejection for Japanese Application No. 2009-244105 dated Mar. 12, 2013.

* cited by examiner

*Primary Examiner* — Shelby Fidler
(74) *Attorney, Agent, or Firm* — Frommer Lawrence & Haug LLP

(57) ABSTRACT

A liquid supply apparatus configured to supply a liquid for a liquid-consuming apparatus, includes: a liquid container including a storage chamber which stores the liquid and an engaging portion which is provided on an outer surface of the liquid container; and an attaching section to which the liquid container is attachable, which is formed with an opening, and which includes: a holding member configured to have an attitude which is changable between a first attitude and a second attitude; a cover configured to selectively have an open attitude for opening the opening and a close attitude for closing the opening; and a closing-preventive member on the cover and configured to prevent the cover from having the close attitude when the holding member has an attitude different from the first attitude.

12 Claims, 10 Drawing Sheets

LIQUID SUPPLY APPARATUS AND LIQUID-CONSUMING APPARATUS FOR ENSURING COMPLETE INK CARTRIDGE ATTACHMENT

CROSS REFERENCE TO RELATED APPLICATION

The present application claims priority to and the benefit of Japanese Patent Application No. 2009-244105, which was filed on Oct. 23, 2009, the disclosure of which is incorporated herein by reference in its entirety.

BACKGROUND OF THE INVENTION

1. Field of the Invention

The present invention relates to a liquid supply apparatus in which a liquid container is attachable to an attaching section via an opening and a liquid-consuming apparatus which consumes a liquid supplied from the liquid supply apparatus.

2. Description of the Related Art

An image recording apparatus, which records an image on a recording sheet of paper by using an ink, has been hitherto known. The image recording apparatus is provided with an ink-jet recording head, and ink droplets are selectively jetted from nozzles of the recording head toward the recording sheet. The ink droplets are landed on the recording sheet, and thus a desired image is recorded on the recording sheet. The image recording apparatus is provided with a liquid container storing ink to be supplied to the recording head. One example of the liquid container is a liquid cartridge, which is attachable/detachable with respect to an attaching section provided in the image recording apparatus. The liquid cartridge storing ink is also referred to as an ink cartridge.

When ink stored in the ink cartridge is exhausted, the ink cartridge is detached from the attaching section of the image recording apparatus, and a new ink cartridge, which stores ink, is attached to the attaching section. A lock mechanism is known, which is provided in order to position and retain the ink cartridge in the attaching section. Such a lock mechanism is described in, for example, Japanese Patent Application Laid-open No. 2009-132098.

The attaching section as described above is provided with an cover, which is configured to open and close, for preventing a user from unexpectedly touching the ink cartridge and/or for preventing a user from releasing the locked ink cartridge. The cover may constitute a part of an outer case of the image recording apparatus forming the appearance of the image recording apparatus. Further, in order to prevent the image recording apparatus from performing the image recording when the cover is open, a sensor, which detects that the cover is closed, may be provided, and the image recording apparatus may be controlled, such that the image recording is not performed unless the cover is closed.

The lock mechanism described above has a lever, and the ink cartridge is selectively locked or released in accordance with the rotation of the lever. However, when the ink cartridge is incompletely attached to the attaching section, the following situation may arise. That is, although the lever seemingly locks the ink cartridge, the lever does not actually lock the ink cartridge completely, and therefore the ink cartridge remains incompletely attached. In particular, if the attitude of the lever does not vary so much between when the ink cartridge is locked by the lever and when the ink cartridge is not locked by the lever, a user tends to misunderstand that the ink cartridge is completely locked, even when the ink cartridge is not completely locked. The incomplete attachment of the ink cartridge as described above causes the occurrence of ink leakage, mixing of air into an ink flow passage from the ink cartridge to the recording head, etc.

SUMMARY OF THE INVENTION

The present invention has been made taking the foregoing circumstances into consideration, an object of which is to provide a liquid supply apparatus capable of preventing a cover from having a close attitude when a liquid container is incompletely attached to an attaching section, and to provide a liquid-consuming apparatus consuming a liquid supplied from the liquid supply apparatus.

According to an aspect of the present invention, there is provided a liquid supply apparatus configured to supply a liquid for a liquid jetting apparatus, comprising: a liquid container comprising: a storage chamber configured to store the liquid therein; and an engaging portion provided on an outer surface of the liquid container; and an attaching section to which the liquid container is attachable, which is formed with an opening through which the liquid container is configured to be inserted into the attaching section in an insertion direction, wherein the attaching section comprises: a holding member configured to have an attitude which is changable between a first attitude and a second attitude, wherein the holding member is urged toward the first attitude, and wherein the holding member is configured to engage with the engaging portion of the liquid container to hold the liquid container at a particular position when the holding member has the first attitude, and the holding member is configured not to engage with the engaging portion of the liquid container when the holding member has the second attitude; a cover configured to selectively have an open attitude and a close attitude, wherein the opening is not covered by the cover and opened when the cover has the open attitude, and the opening is covered by the cover and closed when the cover has the close attitude; and a closing-preventive member provided on the cover and configured such that, when the cover moves toward the close attitude, the closing-preventive member does not abut against the holding member having the first attitude and abuts against the holding member having an attitude different from the first attitude and thereby preventing the cover from having the close attitude.

The liquid container is inserted into the attaching section via the opening when the opening is not covered by the cover and opened. When the liquid container arrives at the particular position, the holding member engages with the engaging portion of the liquid container to hold the liquid container at the particular position. Then, when the cover is made to have the close attitude, the opening is covered by the cover and closed. When the holding member has the first attitude, the closing-preventive member does not abut against the holding member, and therefore the cover may have the close attitude.

When the liquid container is not inserted up to the particular position and the holding member has an attitude different from the first attitude, the closing-preventive member abuts against the holding member during the movement of the cover toward the close attitude. Thus, the cover is prevented from having the close attitude. Accordingly, the cover is prevented from having the close attitude when the liquid container is incompletely attached to the attaching section.

DESCRIPTION OF THE PREFERRED EMBODIMENTS

Embodiments of the present invention will be explained below with reference to the drawings. It goes without saying that the embodiments of the present invention are exemplified merely as examples of the present invention, and the embodiments can be appropriately changed within a scope in which the gist or essential characteristics of the present invention is/are not changed.

Figure 10:
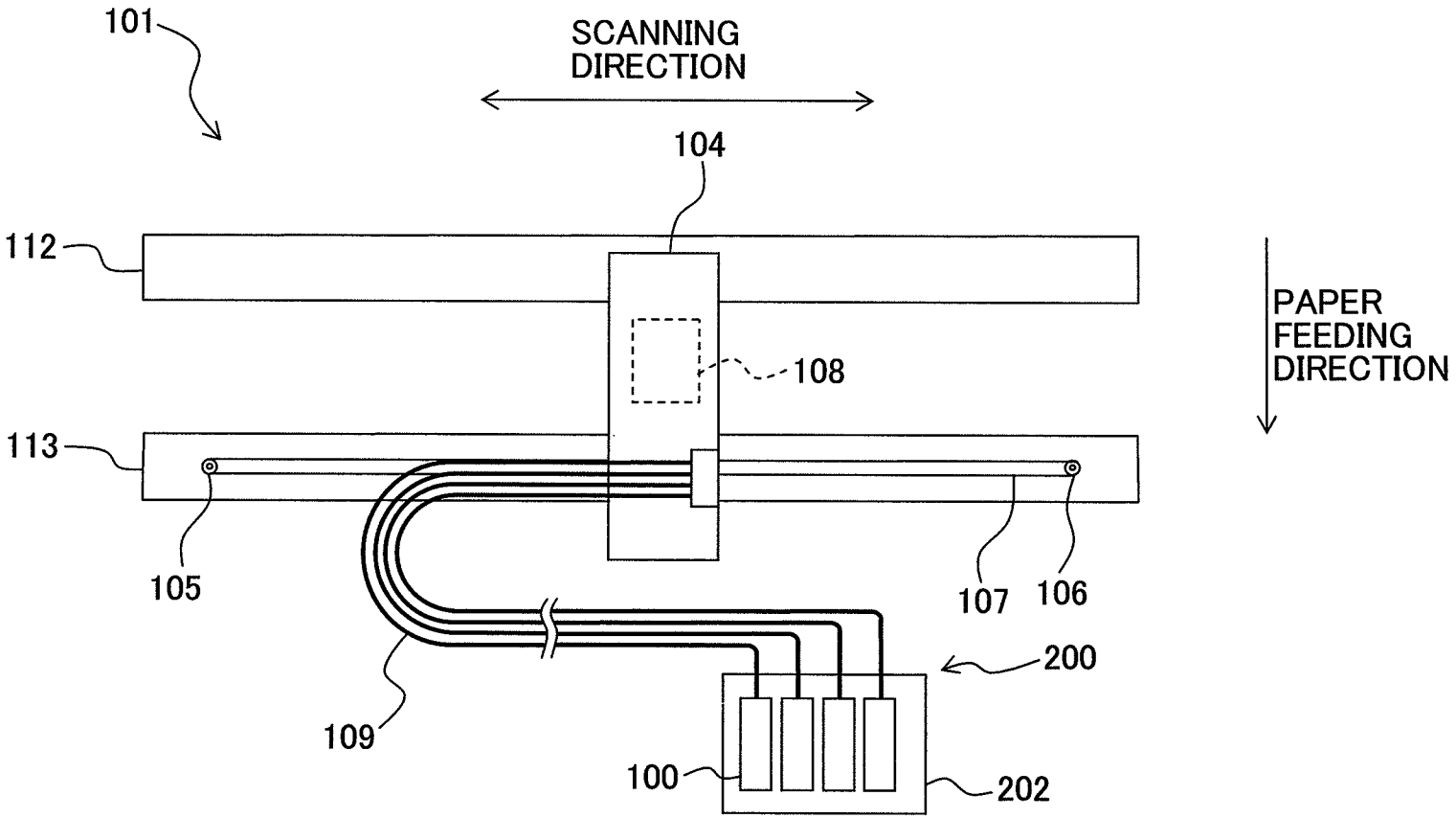
FIG. 10 is a schematic plan view of main components of an ink-jet printer as a liquid-consuming apparatus which comprises the liquid supply apparatus of FIG. 1, as one apparatus.

At first, an overall configuration of an ink-jet printer 101, as an example of a liquid-consuming apparatus (hereinafter referred to as "ink-consuming apparatus" as well), will be explained. As shown in FIG. 10, the ink-jet printer 101 comprises a pair of guide rails 112, 113, which extend in the left-right direction and are arranged substantially in parallel with each other. A carriage 104 is supported by the guide rails 112, 113, such that the carriage 104 is slidable in the left-right direction. A pair of pulleys 105, 106 is provided in the vicinity of left and right ends of the guide rail 113. The carriage 104 is coupled to a timing belt 107 wound around the pulleys 105, 106. A motor (not shown), which is configured to be driven and rotated in the positive or negative (clockwise or counter-clockwise) direction, is provided for the one pulley 106. When the pulley 106 is driven and rotated in the positive or negative direction, the timing belt 107 is moved in the leftward direction or the rightward direction. Accompanying this movement of the timing belt 107, the carriage 104 is moved in the left-right direction along with the guide rails 112, 113.

Four ink cartridges 100 are configured to be detachably attached to four cartridge attaching sections 202 of the ink-jet printer 101, respectively. Four flexible ink supply tubes 109 are connected to the carriage 104 and the four cartridge attaching sections 202 in order to supply four color inks (for example, black, cyan, magenta, and yellow) from the four ink cartridges 100 to the carriage 104, respectively. The carriage 104 is provided with an ink jetting apparatus 108 (liquid jetting apparatus). The inks (liquids) supplied from the ink cartridge 100 are jetted from the ink jetting apparatus 108 toward a recording medium (for example, recording sheet of paper) which is transported in a direction (paper feeding direction) perpendicular to the moving direction of the carriage 104 below the ink jetting apparatus 108.

Next, a schematic configuration of an ink supply apparatus 200, as an example of a liquid supply apparatus, will be explained. In this embodiment, the ink-jet printer 101, as an example of a liquid-consuming apparatus, comprises the ink supply apparatus 200 as one apparatus. In another embodiment, the ink supply apparatus 200 may be provided separately from the ink-jet printer 100, and the ink supply apparatus 200 and the ink-jet printer 100 may be connected via flexible tubes, etc.

Figure 1:
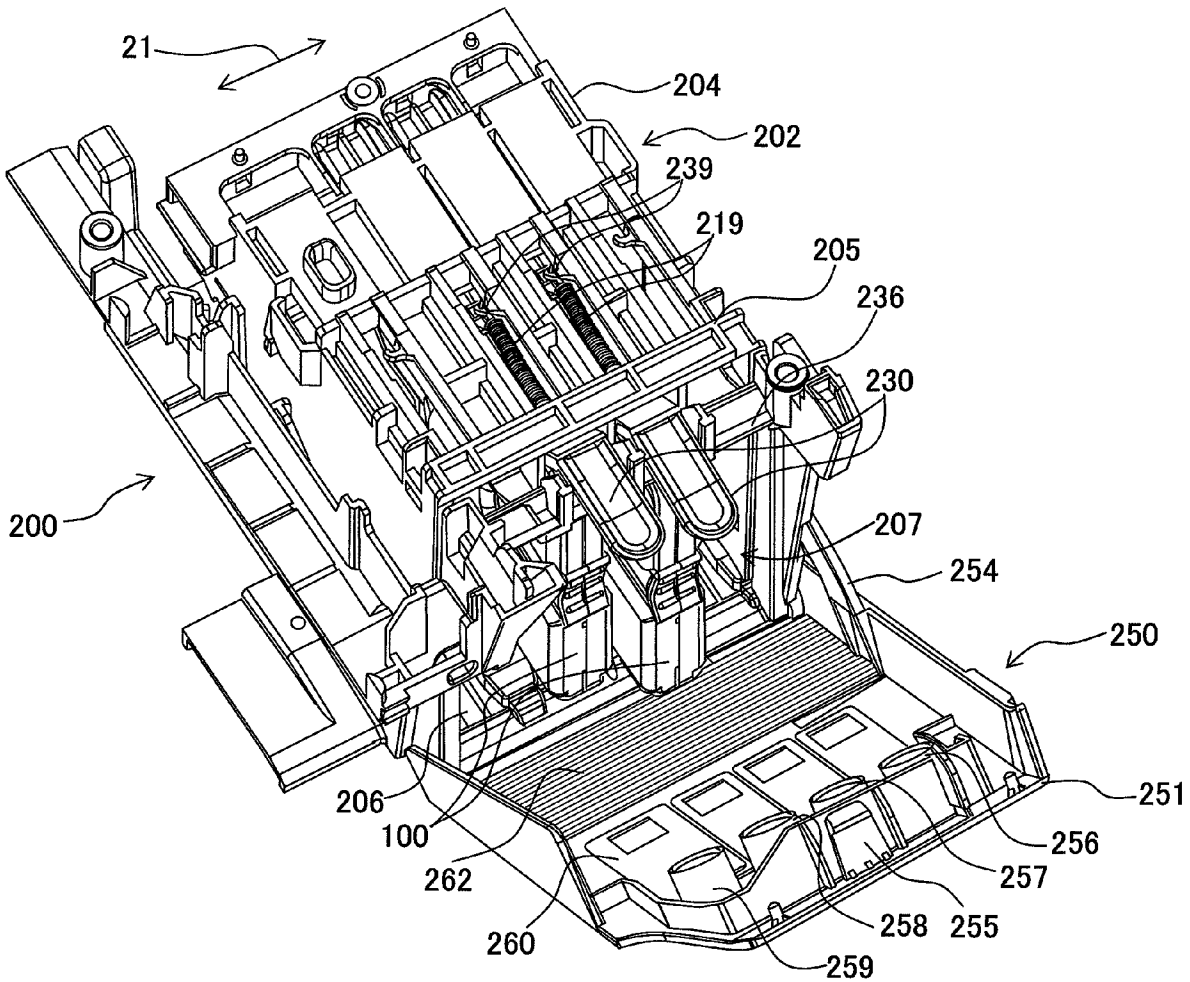
FIG. 1 is a perspective view of an ink supply apparatus according to an embodiment of the present invention.

As shown in FIG. 1, the ink supply apparatus 200 comprises the ink cartridges 100 and the cartridge attaching sections 202. The ink cartridge 100 is attachable/detachable with respect to the cartridge attaching section 202. The ink supply apparatus 200 is configured, such that the four types of the ink cartridges 100 are attachable/detachable with respect to four cartridge attaching sections 202, respectively. The ink, which has one of colors of cyan, magenta, yellow, and black, is stored in one of the ink cartridges 100. The respective inks, which are stored in the respective ink cartridges 100, are supplied to the ink jetting apparatus 108 from the respective ink cartridges 100 attached to the cartridge attaching sections 202 in the ink supply apparatus 200. The ink cartridge 100 is an example of a liquid container, and the cartridge attaching section 202 is an example of an attaching section.

The structure of the ink cartridge 100 will be explained in detail below. As shown in FIGS. 2A to 3B, the ink cartridge 100 has a flat shape having a substantially hexahedral outer shape. That is, the ink cartridge 100 is a flat rectangular parallelepiped. In particular, the outer shape of the ink cartridge 100 has a substantially rectangular parallelepiped shape which is slender in the widthwise direction (direction of an arrow 31) and is long in the height direction (direction of an arrow 32) and in the depth direction (direction of an arrow 33) as compared with the dimension in the widthwise direction. The ink cartridge 100 is inserted into the cartridge attaching section 202 in a direction indicated by an arrow 30 (hereinafter referred to as "insertion direction 30"), and the ink cartridge 100 is pulled out in a direction indicated by an arrow 29 (hereinafter referred to as "pull-out direction 29") in an upstanding state shown in FIGS. 2A to 3B, i.e., in a state that the bottom surface of the ink cartridge 100 in FIGS. 2A to 3B faces downward and the upper surface of the ink cartridge 100 in FIGS. 2A to 3B faces upward. The pull-out direction 29 and the insertion direction 30 are the two directions which are opposite to one another. In this specification, the usage of the expression "bottom surface" and "upper surface" of the ink cartridge 100 indicate the bottom surface and the upper surface when the ink cartridge 100 is in the upstanding state shown in FIGS. 2A to 3B, unless otherwise stated.

Figure 4:
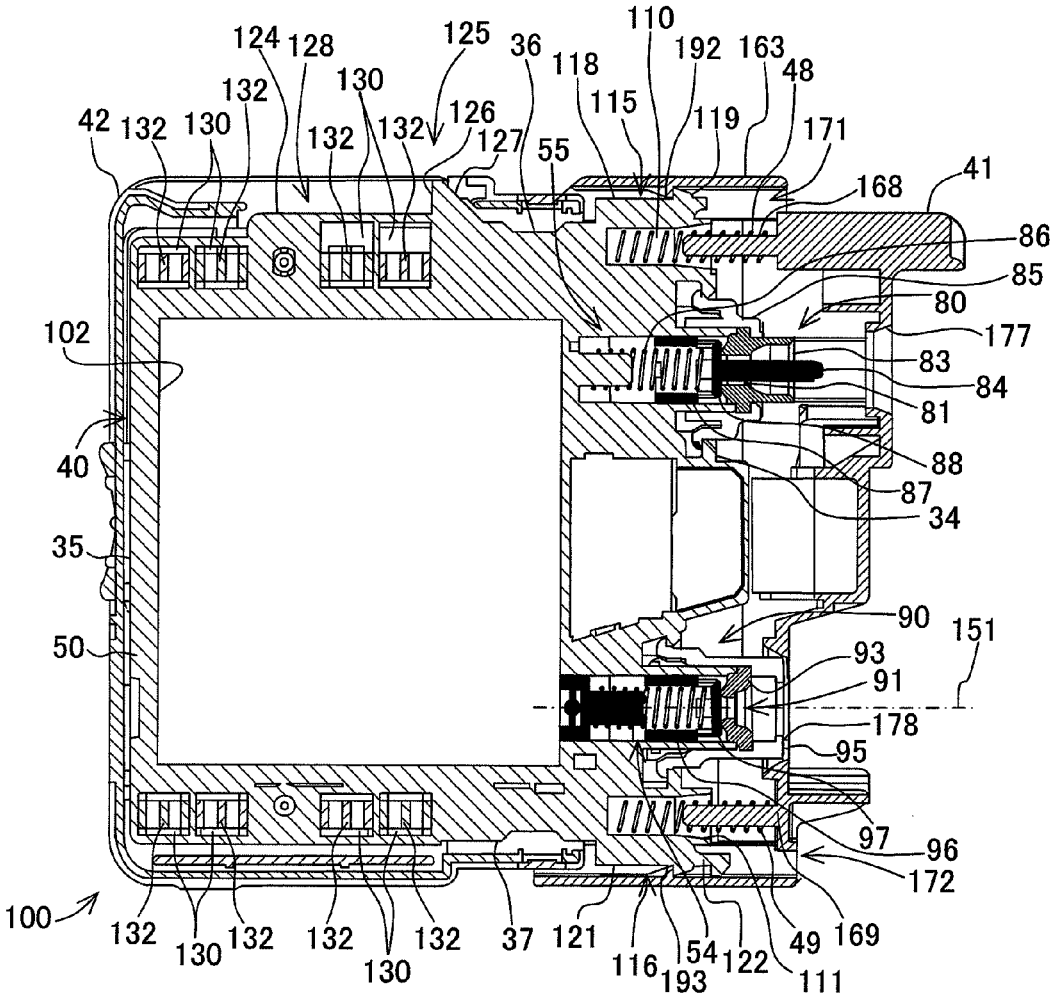
FIG. 4 is a cross-sectional view of the ink cartridge of FIGS. 2A and 2B taken along a IV-IV cutting line shown in FIG. 2A.

The ink cartridge 100 comprises a container body 40 (see FIG. 4) in which the ink is stored, a slider 41, a body cover 42, and coil springs 48, 49 (see FIG. 4). The slider 41 and the body cover 42 form the general appearance of the ink cartridge 100. The container body 40 is generally covered with the slider 41 and the body cover 42.

The body cover 42 generally covers the container body 40. However, a stopper 125 of the container body 40 is exposed from the body cover 42. The slider 41 is positioned on the front side of the body cover 42 in the insertion direction 30, and the slider 41 covers a front surface side portion 46 of the body cover 42. The front surface side portion 46 of the body cover 42 is a front portion of the body cover 42 in the insertion direction 30.

The slider 41 is slidable in the depth direction of the ink cartridge 100 (direction of the arrow 33). The slider 41 is configured to slide between the first position (see FIG. 2A) which is separated farthest from a front surface 34 of the container body 40 (see FIG. 4) toward the front side in the insertion direction 30 and the second position (see FIG. 2B) which is positioned nearest to the front surface 34 of the container body 40. When the slider 41 is positioned at the second position, a cap 95 (described later) of an ink supply valve 90 (see FIG. 4) protrudes from the slider 41 to the outside of the slider 41. When the slider 41 is positioned at the first position, the cap 95 is retracted into the slider 41.

The structure of the container body 40 will be explained in detail below. The container body 40 has a generally flat shape having a substantially hexahedral outer shape. In this embodiment, as shown in FIG. 4, the front surface 34 is the outer surface of the container body 40 which is disposed on the front side of the container body 40 in the insertion direction 30, and a back surface 35 is the outer surface of the container body 40 which is disposed on the back side of the container body 40 in the insertion direction 30. An upper surface 36 is the outer surface of the container body 40 which is disposed on the upper side of the container body 40 in the direction of the gravity (downward direction as viewed in FIG. 4), and a bottom surface 37 is the outer surface of the container body 40 which is disposed on the lower side of the container body 40 in the direction of the gravity.

The container body 40 comprises a frame 50, an atmospheric air communication valve 80, the ink supply valve 90, and films (not shown) made of transparent resin. Although not shown in FIG. 4, the films are welded to the both side surfaces of the frame 50 in the widthwise direction (direction of the arrow 31 shown in FIG. 2), respectively. A certain space is formed in a liquid-tight manner within the films and the frame 50. This space is an ink chamber 102, as an example of a storage chamber. A predetermined ink is injected into the ink chamber 102, and the ink is stored therein.

In this embodiment, the ink chamber 102 is formed within the frame 50 and the films. However, in another embodiment, for example, the frame 50 itself may have a rectangular parallelepiped container shape, and the internal space thereof may be the ink chamber 102.

The frame 50 is a substantially annular member providing the outer wall of the container body 40. The frame 50 forms the annular shape, forming the front surface 34, the back surface 35, the upper surface 36, and the bottom surface 37 of the container body 40. The widths (sizes or dimensions in the direction of the arrow 31 shown in FIG. 2) of the front surface 34, the back surface 35, the upper surface 36, and the bottom surface 37 are approximately constant. The frame 50 is made of a light-transmissive member, for example, a transparent or semi-transparent resin material. The frame 50 is manufactured, for example, by injection-molding the resin material. Such a resin material includes, for example, polyacetal, nylon, polyethylene, polypropylene, or any combination thereof.

A valve accommodating chamber 55 is formed in an upper portion of the front surface 34 of the frame 50. The valve accommodating chamber 55 is a cylindrical space extending from the front surface 34 of the frame 50 toward the inside of the frame 50. The valve accommodating chamber 55 is open to the outside of the frame 50 via an opening formed in the front surface 34 of the frame 50. The valve accommodating chamber 55 has an inner end positioned opposite to the opening in the depth direction (direction of the arrow 33 shown in FIG. 2), and the valve accommodating chamber 55 is communicated with an upper space (air layer) of the ink chamber 102 at the inner end. The atmospheric air communication valve 80 is accommodated in the valve accommodating chamber 55.

The atmospheric air communication valve 80 is a valve which opens or closes an air passage or route extending from the opening of the valve accommodating chamber 55 to the ink chamber 102. The atmospheric air communication valve 80 comprises a valve element 87, a coil spring 86, a seal member 83, and a cap 85. The valve element 87 is slidable in the depth direction of the container body 40 in the valve accommodating chamber 55. The valve element 87 comprises a lid 88 and a rod 84.

The valve element 87 is configured to slide by being guided by the inner wall of the valve accommodating chamber 55. Accordingly, the valve element 87 is configured to move between a close position in which the lid 88 abuts against the seal member 83 and an open position in which the lid 88 is separated from the seal member 83. When the lid 88 abuts against the seal member 83, an atmospheric air communication port 81 (described later) is closed. When the lid 88 is separated from the seal member 83, the atmospheric air communication port 81 is opened. The rod 84 is configured to protrude substantially in a horizontal direction from the center of the lid 88 via the atmospheric air communication port 81 to the outside of the frame 50. The distal end of the rod 84 is positioned at the outermost position among the members of the container body 40 provided on the front surface 34 side of the container body 40.

The cap 85 is attached to a portion of the frame 50 at which the opening of the valve accommodating chamber 55 is formed in the front surface 34, with the seal member 83 sandwiched between the cap 85 and the portion of the frame 50. The cap 85 and the seal member 83 have through-holes (not shown), respectively, and the through-holes are communicated with each other. The atmospheric air communication port 81, which communicates the inside and the outside of the valve accommodating chamber 55, is formed by the respective through-holes of the cap 85 and the seal member 83.

The coil spring 86 is provided in the valve accommodating chamber 55, and the coil spring 86 urges the valve element 87 toward the close position. In other words, the coil spring 86 urges the valve element 87 in the direction in which the lid 88 approaches the seal member 83. Therefore, the atmospheric air communication valve 80 closes the atmospheric air communication port 81 with the lid 88 urged by the coil spring 86, unless an external force is applied to the valve element 87. On the other hand, when the rod 84 is pressed with an external force, then the lid 88 of the valve element 87 is separated from the seal member 83 against the urging force of the coil spring 86, and the atmospheric air communication port 81 is opened. Accordingly, the air route, which extending from the opening of the valve accommodating chamber 55 to the ink chamber 102, is opened, and the air layer of the ink chamber 102 becomes equal to the atmospheric pressure.

A valve accommodating chamber 54 is formed in a lower portion of the front surface 34 of the frame 50. The valve accommodating chamber 54 is a cylindrical space extending from the front surface 34 of the frame 50 toward the inside of the frame 50. The valve accommodating chamber 54 is open to the outside of the frame 50 via an opening formed in the front surface 34 of the frame 50. The valve accommodating chamber 54 has an inner end positioned opposite to the opening in the depth direction (direction of the arrow 33 shown in FIG. 2), and the valve accommodating chamber 54 is communicated with a lower space of the ink chamber 102 at the inner end. The ink supply valve 90 is accommodated in the valve accommodating chamber 54.

The ink supply valve 90 is a valve which opens or closes an ink passage or route extending from the front surface 34 of the frame 50 to the ink chamber 102. The ink supply valve 90 comprises a seal member 93, a cap 95, a coil spring 96, and a valve element 97.

The cap 95 is attached to a portion of the frame 50 at which the opening of the valve accommodating chamber 54 is formed in the front surface 34, with the seal member 93 sandwiched between the cap 95 and the portion of the frame 50. The seal member 93 has a substantially cylindrical outer shape. The seal member 93 has an inner hole which constitutes a part of an ink supply port 91 (described later). The seal member 93 is made of an elastically deformable material such as rubber or the like. When the seal member 93 contacts another member tightly, the contact surface between the seal member 93 and the other member may become liquid-tight. Further, when the other member slides on the seal member 93, the seal member 93 causes friction therebetween. The seal member 93 is attached to the valve accommodating chamber 54 with an axis 151 of the inner hole being parallel to the pull-out direction 29 and the insertion direction 30. The diameter of the inner hole of the seal member 93 is slightly less than the outer diameter of an ink needle 209 (described later). Therefore, when the ink needle 209 is inserted into the inner hole of the seal member 93, the ink needle 209 elastically deforms the seal member 93, such that the diameter of the inner hole is enlarged, and thus the ink needle 209 is brought in tight contact with the seal member 93.

A through-hole (not shown) is formed through the cap 95. The through-hole of the cap 95 is aligned with the axis 151 of the inner hole of the seal member 93. The ink supply port 91, which communicates the inside and the outside of the valve accommodating chamber 54, is formed by the inner hole of the seal member 93 together with the through-hole of the cap 95 at the front surface 34 of the frame 50. The tubular ink needle 209 (see FIG. 7) is inserted into the ink supply port 91 when the ink cartridge 100 is attached to the cartridge attaching section 202.

The valve element 97 is slidable by being guided by the inner wall of the valve accommodating chamber 54, and the valve element 97 is configured to move between an open position in which the valve element 97 is separated from the seal member 93 and a close position in which the valve element 97 is brought in tight contact with the seal member 93. The valve accommodating chamber 54 is slightly larger than the outer shape of the valve element 97 in the radial direction. The valve accommodating chamber 54 has a sufficient length in its axial direction to accommodate the coil spring 96 and to allow the sliding movement of the valve element 97. The valve element 97 has a cylindrical shape, and the valve element 97 has an abutment wall facing the seal member 93. When the abutment wall is brought in tight contact with the seal member 93, the ink supply port 91 is closed. A gap, which is formed to such an extent that ink is successfully allowed to flow, is provided between the circumferential surface of the valve element 97 and the inner wall of the valve accommodating chamber 54.

The coil spring 96 is provided in the valve accommodating chamber 54, and the coil spring 96 urges the valve element 97 toward the close position. In other words, the coil spring 96 urges the valve element 97 in the direction in which the valve element 97 approaches the seal member 93. Therefore, the ink supply port 91 is closed by the valve element 97 brought in tight contact with the seal member 93 by the coil spring 96, unless an external force is applied to the valve element 97. On the other hand, when the ink needle 209 is inserted into the ink supply port 91, the distal end of the ink needle 209 pushes and moves the valve element 97, and the valve element 97 is separated from the seal member 93 against the urging force of the coil spring 96, while the ink supply port 91 is sealed in a liquid-tight manner by the tight contact between the outer circumferential surface of the ink needle 209 and the seal member 93. Then, ink flows from the ink chamber 102 into the internal space of the ink needle 209 via an opening formed in the distal end of the ink needle 209, and flow out to the outside of the ink cartridge 100 via the ink needle 209.

Spring accommodating chambers 110, 111 are formed in the vicinity of the upper end and in the vicinity of the lower end of the front surface 34 of the frame 50, respectively. Each of the spring accommodating chambers 110, 111 is a substantially cylindrical space bored toward the ink chamber 102 from the front surface 34 of the frame 50. The coil springs 48, 49 are accommodated in the spring accommodating chambers 110, 111, respectively. The coil springs 48, 49 urge the slider 41 in the insertion direction 30. The positions of the spring accommodating chambers 110, 111 and the inner diameters or the depth dimensions of the spring accommodating chambers 110, 111 are appropriately determined depending on the specification of the springs to be accommodated therein. However, in order for the coil springs 48, 49 to urge the slider 41, which is lengthy in the height direction of the container body 40 (direction of the arrow 32), evenly to maintain the stable attitude of the slider 41 with respect to the container body 40, it is desirable that the pair of spring accommodating chambers 110, 111 is positioned at the upper and lower positions which are separated from each other in the height direction of the container body 40 as in this embodiment.

A support member 115 is provided on a front portion of the upper surface 36 of the frame 50 in the insertion direction 30. Further, a support member 116 is provided on a front portion of the bottom surface 37 of the frame 50 in the insertion direction 30. The respective support members 115, 116 are formed integrally with the frame 50. The respective support members 115, 116 are configured to engage with protruding tabs 192, 193 formed on the slider 41, respectively, to slidably support the slider 41 with respect to the container body 40. The engagement of support members 115, 116 and the slider 41 prevents the slider 41 from being removed from the container body 40.

The support member 115 has a base 118 which protrudes vertically upwardly from the upper surface 36 of the frame 50, and a hook portion 119 which is formed at an end of the base 118 positioned on the side of the front surface 34. The hook portion 119 has such a hook shape that the hook portion 119 extends in the insertion direction 30 from the base 118 and is bent upwardly. The support member 116 has a base 121 which protrudes vertically downwardly from the bottom surface 37 of the frame 50, and a hook portion 122 which is formed at an end of the base 121 positioned on the side of the front surface 34. The hook portion 122 has such a hook shape that the hook portion 122 extends in the insertion direction 30 from the base 121 and is bent downwardly.

A pedestal portion 124 is provided on the upper surface 36 of the frame 50. The pedestal portion 124 has a substantially pedestal shape to protrude upwardly from the upper surface 36. The pedestal portion 124 extends on the upper surface 36 from an intermediate portion in the depth direction (direction of the arrow 33) toward the back side in the insertion direction 30, i.e., toward the back surface 35 of the container body 40. When the container body 40 is covered with the body cover 42, the pedestal portion 124 is exposed to the outside of the body cover 42 via an opening 128 (see FIG. 2) formed through the upper surface of the body cover 42.

The pedestal portion 124 is provided with a stopper 125. The stopper 125 is positioned at a front end of the pedestal portion 124 in the insertion direction 30. The stopper 125 further protrudes upwardly from the upper surface of the pedestal portion 124. The stopper 125 comprises a perpendicular wall 126 which extends substantially perpendicularly to the upper surface of the pedestal portion 124. The perpendicular wall 126 has a perpendicular surface extending substantially perpendicular to the upper surface of the pedestal portion 124 and an upper surface extending substantially parallel to the upper surface of the pedestal portion 124. The stopper 125 further comprises a rib 127 having an upper surface which extends from the upper surface of the perpendicular wall 126 toward the front side in the insertion direction 30 and downward, forming an angle of about 45 degrees with the upper surface of the perpendicular wall 126. When the container body 40 is covered with the body cover 42, the stopper 125 is exposed to the outside of the body cover 42 via the opening 128 (see FIG. 2) provided on the upper surface of the body cover 42. The stopper 125 is provided in order to lock the ink cartridge 100, such that the ink cartridge 100 is not detached from the cartridge attaching section 202 when the ink cartridge 100 is attached to the cartridge attaching section 202. The lock of the ink cartridge 100 is achieved by the engagement between the perpendicular surface of the perpendicular wall 126 of the stopper and a lock portion 237 of a lock arm 230 (described later, see FIG. 7). The perpendicular surface of the perpendicular wall 126 of the stopper 125 is an example of an engaging portion. The rib 127 and the upper surface of the perpendicular wall 126 is an example of a part of a guide portion.

A plurality of through-holes 130 are formed through the frame 50. The respective through-holes 130 penetrate through the frame 50 in the widthwise direction 31 (direction perpendicular to the paper surface of FIG. 4). The four through-holes 130 are formed on the side of the upper surface 36 and the side of the bottom surface 37 of the frame 50, respectively. Engaging pawls 132 of the body cover 42 are engaged with the through-holes 130 respectively, and thus the container body 40 and the body cover 42 are assembled.

The structures of the slider 41 and the body cover 42 will be explained in detail below. As shown in FIGS. 2A to 3B, the body cover 42 has a container shape capable of substantially accommodating the container body 40. The body cover 42 has a flat rectangular parallelepiped outer shape corresponding to the outer shape of the container body 40.

A connecting portion 43 is formed at approximately the center, in the depth direction (direction of the arrow 33), of each of two side surfaces of the body cover 42. The body cover 42 is divided into a back surface side portion 47 which is disposed on the side of the back surface 35 of the container body 40 and the front surface side portion 46 which is disposed on the side of the front surface 34 of the container body 40, with the connecting portion 43 intervening therebetween. The front surface side portion 46 is narrower than the back surface side portion 47 in the widthwise direction (direction of the arrow 31). Accordingly, there is a width difference between the front surface side portion 46 and the back surface side portion 47 in the widthwise direction. The width difference corresponds to the sum of the thickness of each of a left side wall 165 and a right side wall 166 of the slider 41 in the widthwise direction. Thus, the width of the slider 41 has the same size or dimension as that of the width of the back surface side portion 47 of the body cover 42. Further, the front surface side portion 46 of the body cover 42 can be accommodated in the slider 41.

Figure 2B:
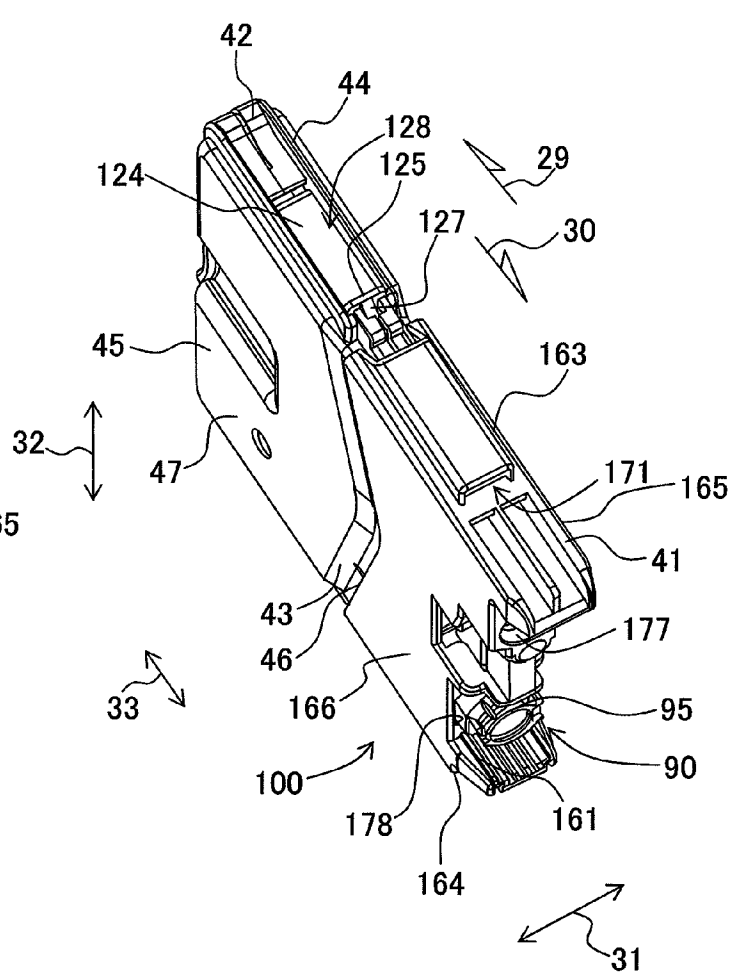
FIG. 2B is a perspective view of the ink cartridge, in which the slider is positioned at a second position.
Figure 2A:
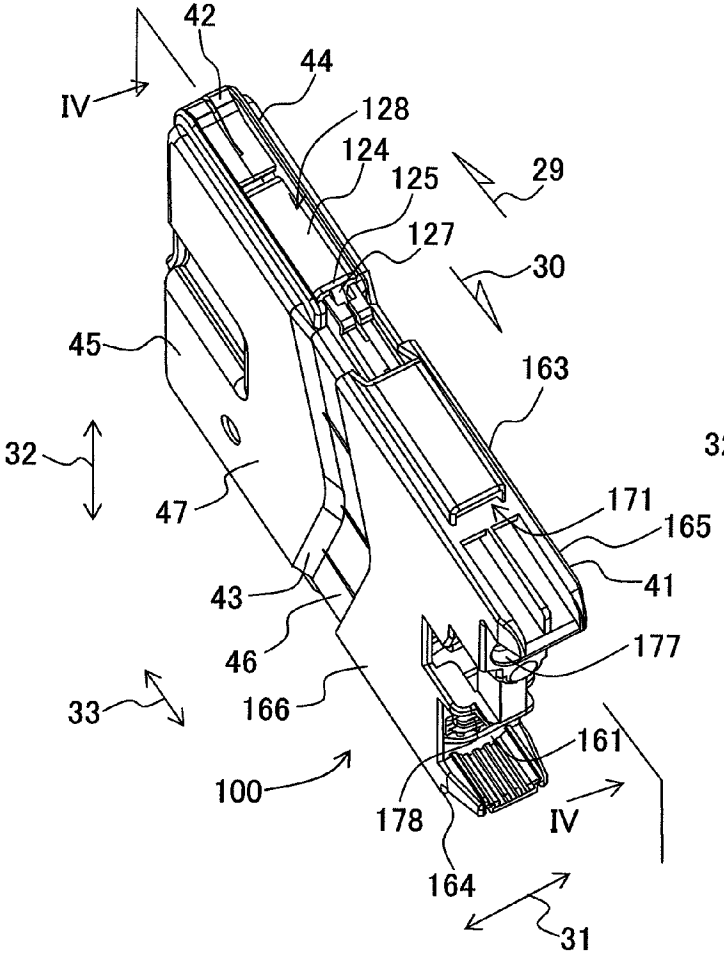
FIG. 2A is a perspective view of an ink cartridge of the ink supply apparatus of FIG. 1, in which a slider is positioned at a first position.
Figure 3A:
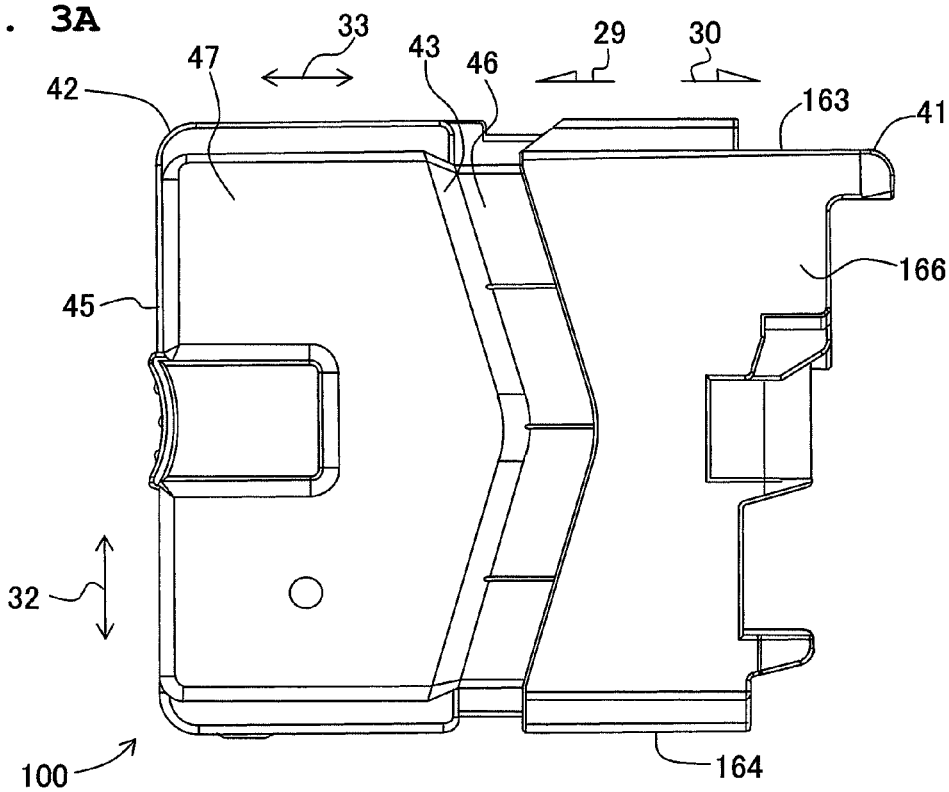
FIG. 3A is a side view of the ink cartridge of FIGS. 2A and 2B, in which the slider is positioned at the first position.
Figure 3B:
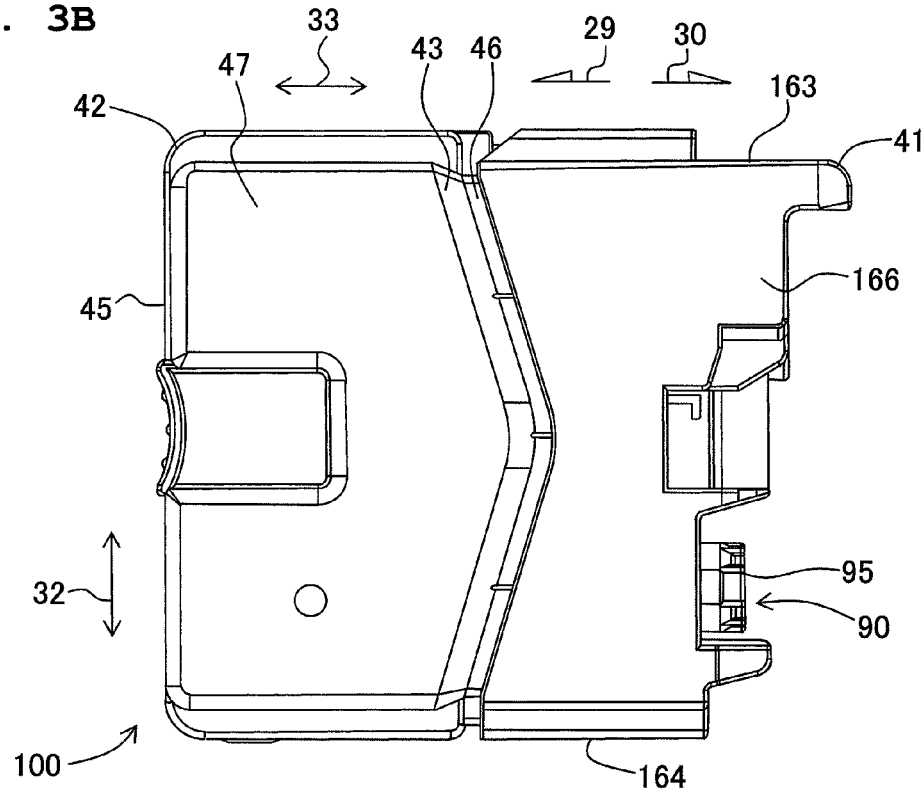
FIG. 3B is a side view of the ink cartridge, in which the slider is positioned at the second position.

As shown in FIGS. 2A, 2B, and 4, the opening 128 is formed through the upper surface of the back surface side portion 47 of the body cover 42. The opening 128 is a rectangular hole through which the stopper 125 and the pedestal portion 124 of the container body 40 are exposed. When the body cover 42 is assembled to the container body 40, the pedestal portion 124 and the stopper 125 are exposed to the outside of the ink cartridge 100 through the opening 128.

As shown in FIGS. 2A and 2B, the body cover 42 comprises a pair of left cover 44 and right cover 45 which have symmetrical shapes with respect to the widthwise direction (direction of the arrow 31). The left cover 44 and the right cover 45 have the plurality of engaging pawls 132 which protrude from the inner surfaces thereof substantially in a horizontal direction (see FIG. 4). The engaging pawls 132 are engaged with the through-holes 130 of the container body 40 respectively, and the container body 40, the left cover 44, and the right cover 45 are assembled, such that the container body 40 is interposed between the left cover 44 and the right cover 45.

The slider 41 has a container shape capable of accommodating the front surface side portion 46 of the body cover 42, and the slider 41 has a flat outer shape. In particular, the slider 41 has a front wall 161 which corresponds to the front surface 34 of the container body 40, an upper wall 163 which corresponds to the upper surface of the front surface side portion 46 of the body cover 42, a lower wall 164 which corresponds to the lower surface of the front surface side portion 46, and the left side wall 165 and the right side wall 166 which correspond to the side surfaces of the front surface side portion 46, respectively. The front surface side portion 46 of the body cover 42 is accommodated in the internal space of the slider 41 surrounded by the respective walls of the slider 41. The upper surface of the upper wall 163 is an example of a part of a guide portion.

As shown in FIG. 4, rods 168, 169 are provided in the slider 41. The respective rods 168, 169 protrude substantially in a horizontal direction from the inner surface of the front wall 161 of the slider 41 toward the front surface 34 of the container body 40. The rod 168 is positioned on the upper side of the front wall 161, and the rod 169 is positioned on the lower side of the front wall 161. The rod 168 is fitted into the coil spring 48, which is positioned in the spring accommodating chamber 110 of the container body 40. The rod 169 is fitted into the coil spring 49, which is positioned in the spring accommodating chamber 111 of the container body 40. When the respective coil springs 48, 49 contracts, the respective rods 168, 169 are inserted into the spring accommodating chambers 110, 111, respectively.

A sliding groove 171 is formed in the inner surface side of the upper wall 163 of the slider 41. The sliding groove 171 is formed by the upper wall 163, a part of the left side wall 165, and a part of the right side wall 166. The sliding groove 171 has an inverted U-shaped form, the lower side of which is open as viewed in a vertical cross section. The sliding groove 171 is open to the outside of the slider 41 on the side of the front wall 161. The protruding tab 192 vertically extends downward from the inner surface of the upper wall 163 into the sliding groove 171. The upper surface of the support member 115 is slidable on the protruding tab 192. However, the hook portion 119 of the support member 115 is configured to abut against the protruding tab 192. The hook portion 119 abuts against the protruding tab 192 from the side of the front wall 161. Owing to this abutment, the slider 41 is prevented from being disengaged from the container body 40. The sliding movement of the slider 41 with respect to the container body 40 is guided in a constant direction by the base 118, and the slider 41 is slidable with respect to the container body 40 within a range in which the hook portion 119 does not abut against the protruding tab 192.

A sliding groove 172 is formed in the inner surface side of the lower wall 164 of the slider 41. The sliding groove 172 is formed by the lower wall 164, a part of the left side wall 165, and a part of the right side wall 166. The sliding groove 172 has a U-shaped form, the upper side of which is open as viewed in a vertical cross section. The sliding groove 172 is open to the outside of the slider 41 on the side of the front wall 161. The protruding tab 193 vertically extends upward from the inner surface of the lower wall 164 into the sliding groove 172. The lower surface of the support member 116 is slidable on the protruding tab 193. However, the hook portion 122 of the support member 116 is configured to abut against the protruding tab 193. The hook portion 122 abuts against the protruding tab 193 from the side of the front wall 161. Owing to this abutment, the slider 41 is prevented from being disengaged from the container body 40. The sliding movement of the slider 41 with respect to the container body 40 is guided in a constant direction by the base 121, and the slider 41 is slidable with respect to the container body 40 within a range in which the hook portion 122 does not abut against the protruding tab 193. The respective protruding tabs 192, 193 are disposed at the same position in the depth direction of the slider 41 (direction of the arrow 33). Therefore, the position of the slider 41, at which the hook portion 119 abuts against the protruding tab 192, is the same as the position of the slider 41 at which the hook portion 122 abuts against the protruding tab 193.

The slider 41 is urged by the coil springs 48, 49 in the direction in which the slider 41 is separated from the front surface 34 of the container body 40. The hook portions 119, 122 abut against the protruding tabs 192, 193 respectively when an external force is not applied to the slider 41, and the slider 41 remains at the first position shown in FIG. 3A. On the other hand, when an external force is applied to the front wall 161 of the slider 41 toward the container body 40, the slider 41 may slide to the second position shown in FIG. 3B against the urging forces of the coil springs 48, 49.

The slider 41 has an opening 177 which is formed on the upper side of the front wall 161. The height position (position in the direction of the arrow 32 shown in FIG. 2) of the opening 177 corresponds to the height position of the atmospheric air communication valve 80. The opening 177 is circular as viewed from the side of the front wall 161. The opening 177 has such a size that a pressing portion 216 (described later, see FIG. 7), which is provided at the cartridge attaching section 202, is insertable thereinto. The pressing portion 216 is inserted into the opening 177 during the process in which the ink cartridge 100 is attached to the cartridge attaching section 202.

The slider 41 has an opening 178 which is formed on the lower side of the front wall 161. The height position (position in the direction of the arrow 32 shown in FIG. 2) of the opening 178 corresponds to the height position of the ink supply valve 90. The opening 178 has such a shape and a size that the cap 95 of the ink supply valve 90 is insertable thereinto. The cap 95 protrudes from the opening 178 to the outside of the slider 41 when the slider 41 is at the second position.

The structure of the cartridge attaching sections 202 will be explained in detail below. As shown in FIG. 1, the cartridge attaching sections 202 are formed by a frame 204 which has a generally rectangular parallelepiped outer shape having an opening 207. The respective ink cartridges 100 are accommodated in the internal space of the frame 204 respectively. In this embodiment, one cartridge attaching section 202 provides a space for accommodating one ink cartridge 100. In other words, the four cartridge attaching sections 202 are arranged and aligned in a widthwise direction 21 of the frame 204, corresponding to the four ink cartridges 100. The four ink cartridges 100, which correspond to the respective colors of cyan, magenta, yellow, and black, can be accommodated in the respective cartridge attaching sections 202. The widthwise direction 21 of the frame 204, in which the cartridge attaching sections 202 are aligned, is a horizontal direction perpendicular to the insertion direction 30 of the ink cartridges 100. Moreover, the widthwise direction 21 is parallel to the widthwise direction of the ink cartridges 100 (direction of the arrow 31 shown in FIG. 2) when the ink cartridge 100 is attached to the cartridge attaching section 202.

Although not shown in the respective drawings, the frame 204 comprises three plates which compact and divide the internal space into four spaces. The ink cartridges 100 are accommodated in the four spaces comparted and divided by the plates respectively. The plate is a thin plate which extends toward the opening 207 from an inner end of the frame 204 positioned opposite to the opening 207. The plate extends in the upward and downward directions in the internal space of the frame 204. The respective plates are arranged in parallel at predetermined intervals in the widthwise direction 21 of the frame 204. The distance between the plate and the inner surface of a side wall of the frame 204, or the distance between the pair of next-neighboring plates corresponds to the width of the ink cartridge 100 to be accommodated therebetween. The ink cartridges 100 are accommodated in the cartridge attaching sections 202 having the respective spaces comparted and formed by the frame 204 and the plates. The ink cartridges 100 are inserted into the cartridge attaching sections 202 via the opening 207 in the insertion direction 30.

Four guide grooves 206 are formed in the inner surface of a bottom wall of the frame 204. Each of the guide grooves 206 is provided between the plate and the inner surface of a side wall of the frame 204, or between the pair of next-neighboring plates. The guide groove 206 is formed to have a straight line shape extending from the opening 207 of the frame 204 to the inner end of the frame 204. The ink cartridge 100, which is accommodated in one of the spaces in the frame 204, is guided by the corresponding guide groove 206, and the ink cartridge 100 is inserted and pulled out in the predetermined insertion direction 30 and the pull-out direction 29 with respect to the frame 204 along the guide groove 206. The pull-out direction 29 is the direction which extends from the inner end of the frame 204 to the opening 207 of the frame 204, and the insertion direction 30 is the direction which extends from the opening 207 of the frame 204 to the inner end of the frame 204.

Figure 7:
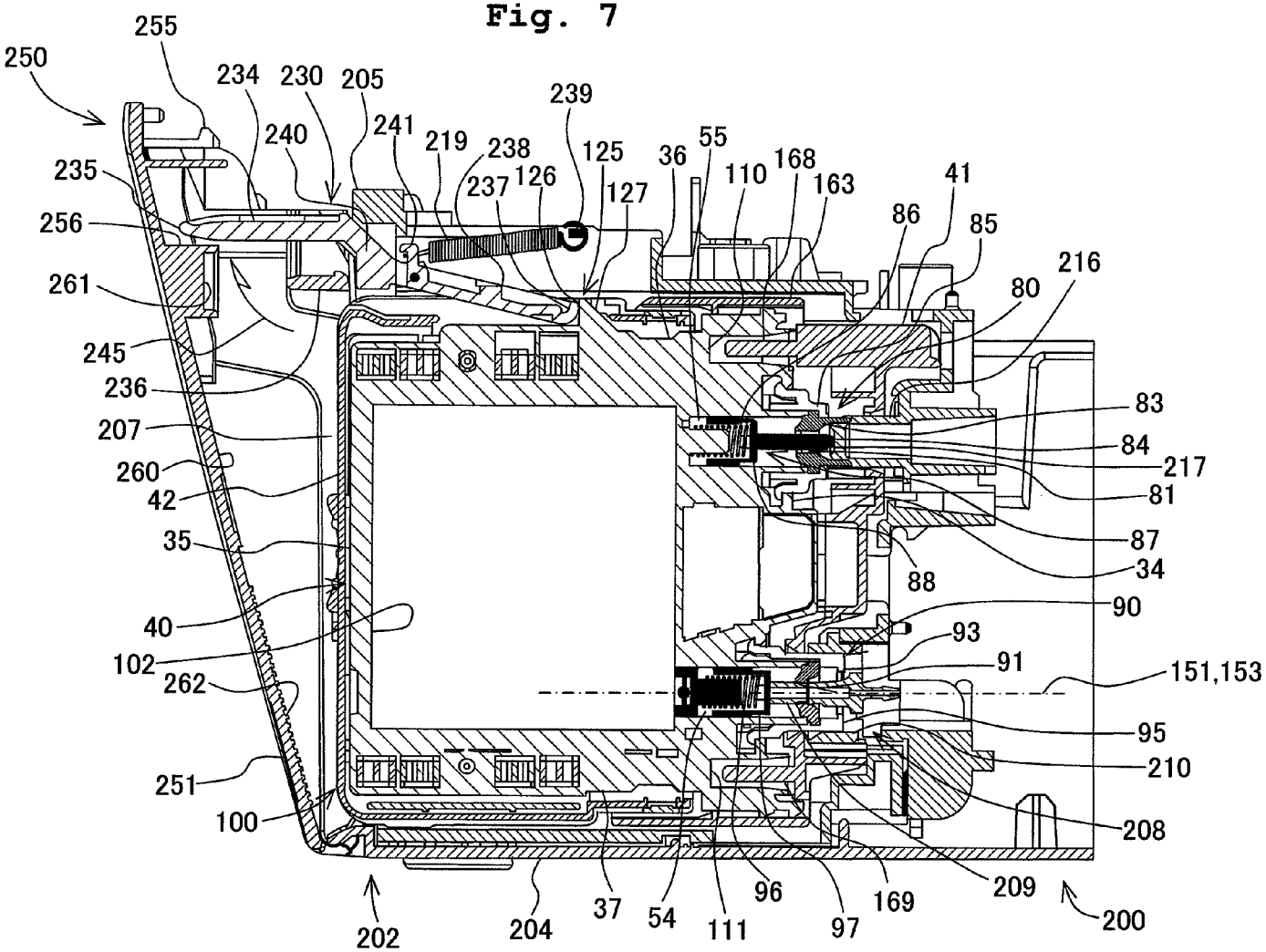
FIG. 7 is a cross-sectional view of the ink supply apparatus of FIG. 1, in which the ink cartridge of FIGS. 2A and 2B is locked completely.

As shown in FIG. 7, a joint 208 is provided on a surface of the inner end of the frame 204. The joint 208 is configured to be connected to the ink supply port 91 of the ink cartridge 100 in order to draw ink from the ink chamber 102. Therefore, the four joints 208 are provided corresponding to the four ink cartridges 100 to be attached to the respective cartridge attaching sections 202. The four ink cartridges 100 are accommodated in the frame 204 in the widthwise direction 21 thereof. Therefore, the four joints 208 are also arranged in the widthwise direction 21 of the frame 204. The height positions of the respective joints 208 correspond to the height positions of the ink supply ports 91 of the ink cartridges 100 attached to the cartridge attaching sections 202.

As shown in FIG. 7, each of the joints 208 has the ink needle 209 and a holding portion 210. The ink needle 209 is a cylindrical tube. The ink needle 209 protrudes substantially in a horizontal direction from the surface of the inner end of the frame 204 toward the opening 207. An axis 153 of the ink needle 209 is coincident with the pull-out direction 29. The outer diameter of the ink needle 209 is approximately constant at any portion of the ink needle 209 throughout the ink needle 209 in the axial direction 153, and the outer diameter of the ink needle 209 is slightly greater than the inner diameter of the seal member 93 of the ink supply valve 90. The ink needle 209 is slidable in the direction of the axis 153 while the outer circumferential surface thereof is brought in contact with a surface of the seal member 93 defining the inner hole of the seal member 93, in a liquid-tight manner, causing friction therebetween. The distal end of the ink needle 209 is open. The distal end is inserted into the ink supply valve 90 of the ink cartridge 100 to open the ink supply valve 90. The internal space of the ink needle 209 is a flow passage which leads to the proximal end from the distal end of the ink needle 209. The ink can flow through the flow passage.

Although not shown in the respective drawings, the proximal end of the ink needle 209 is connected to the ink tube 109 at the outside of the frame 204. Accordingly, the ink tube 109 forms the ink flow passage together with the ink needle 209. The ink tube 109 is connected to the liquid jetting apparatus 108 such as a recording head of an ink-jet printer or the like.

The holding portion 210 is provided on the surface of the inner end of the frame 204. The holding portion 210 has a cylindrical shape to surround the proximal end side of the ink needle 209. The axis of the holding portion 210 is approximately coincident with the axis 153 of the ink needle 209. When the ink cartridge 100 is attached to the cartridge attaching section 202, the cap 95 (see FIG. 2B) is fitted into the holding portion 210, and the ink needle 209 is inserted into the seal member 93 (ink supply port 91) of the ink supply valve 90. The ink contained in the ink chamber 102 is allowed to flow into the internal space of the ink needle 209 from the opening formed through the distal end of the ink needle 209, which is positioned in the inside of the ink supply port 91. The ink can flow out to the outside of the ink cartridge 100 from the ink chamber 102 via the ink needle 209.

The pressing portion 216 is provided on the surface of the inner end of the frame 204. The height position of the pressing portion 216 corresponds to the height position of the atmospheric air communication valve 80 of the ink cartridge 100 attached to the cartridge attaching section 202. Therefore, the respective pressing portions 216 are arranged above the respective joints 208 described above. The four pressing portions 216 are aligned in the widthwise direction 21 of the frame 204. Each of the pressing portions 216 has a cylindrical shape to protrude in a horizontal direction from the surface of the inner end of the frame 204 toward the opening 207. A circular recess 217 is formed in the distal end thereof. The pressing portion 216 is inserted into the opening 177 of the ink cartridge 100 during the process in which the ink cartridge 100 is attached to the cartridge attaching section 202. The rod 84 of the atmospheric air communication valve 80 is guided into the recess 217, and the bottom surface of the recess 217 pushes the rod 84 toward the ink chamber 102. As the rod 84 is pushed as described above, the atmospheric air communication port 81 is opened.

As shown in FIGS. 1 and 7, the lock arm 230 and a coil spring 219 are provided at the upper surface of the frame 204. In this embodiment, the combination of the frame 204, the lock arm 230, and the coil spring 219 is an example of a holding member.

The lock arm 230 is provided to lock the ink cartridge 100 attached to the cartridge attaching section 202. The four lock arms 230 are arranged and aligned on the frame 204 in the widthwise direction 21 corresponding to the four ink cartridges 100. In FIG. 1, parts of the lock arms 230 and the coil springs 219 are omitted from the illustration.

Figure 5A:
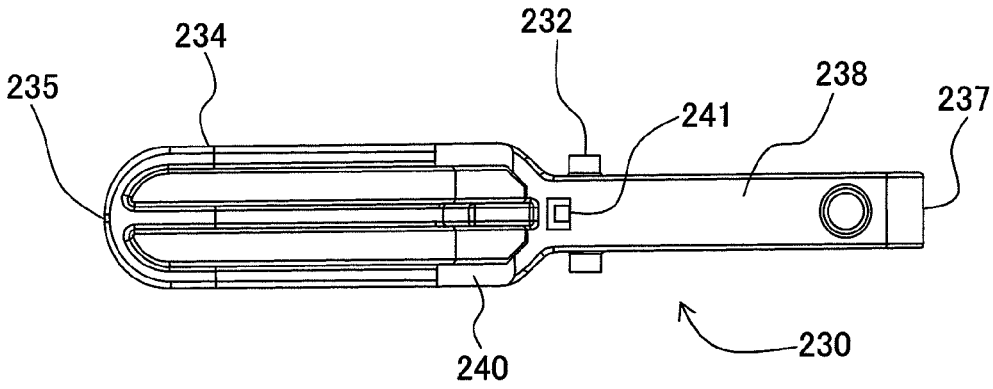
FIG. 5A is a plan view of a lock arm of the ink supply apparatus of FIG. 1.
Figure 5B:
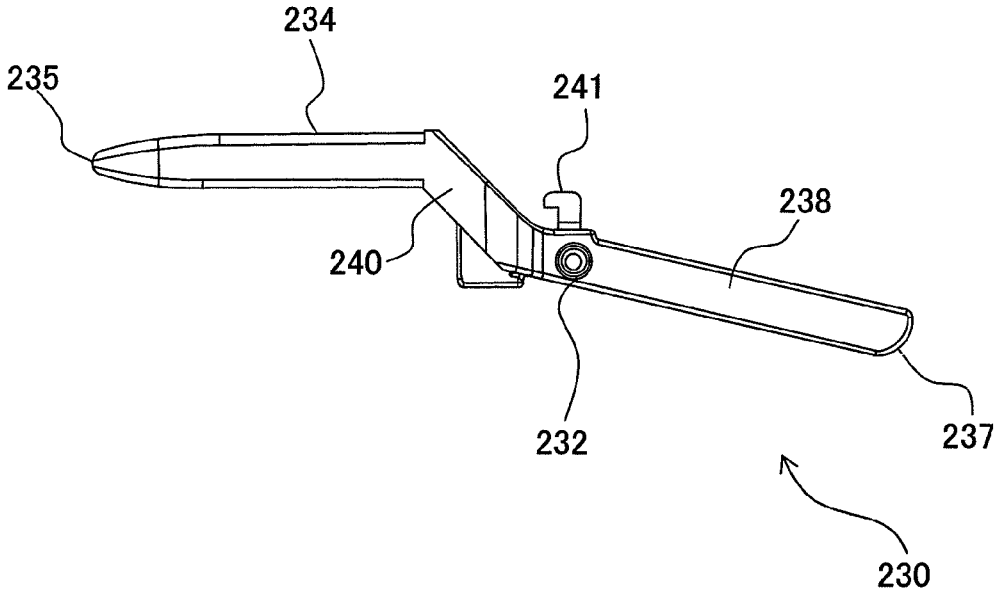
FIG. 5B is a side view of the lock arm.

As shown in FIGS. 5A, 5B, and 7, the lock arm 230 comprises a connecting portion 240, an extending portion 238, as an example of a first extending portion, which extends from the connecting portion 240 into the inside of the cartridge attaching section 202 toward the inner end of the frame 204, an operation lever 234, as an example of a second extending portion, which extends from the connecting portion 240 toward the outside of the cartridge attaching section 202. The direction in which the extending portion 238 extends is non-parallel with the direction in which the operation lever 234 extends, such that the lock arm 230 has a non-straight or bent form. As shown in FIGS. 5A and 5B, a support shaft 232 is provided in the vicinity of the center of the lock arm 230 in the insertion direction 30. The support shaft 232 has a pin-shaped form to protrude in a horizontal direction from the both ends of the lock arm 230 in the widthwise direction 21. Although not shown in the drawings, a pair of bearings, which can support the support shaft 232, are formed at the upper surface of the frame 204. The support shaft 232 is rotatably supported by the pair of bearings respectively, and the lock arm 230 is supported by the frame 204 rotatably about the support shaft 232.

As shown in FIG. 5, the operation lever 234 has a first end connected to the connecting portion 240 and a second end opposite the first end. The second end of the operation lever 234 is a rounded end 235. The extending portion 238 has a first end connected to the connecting portion 240 and a second end opposite the first end of the extending portion 238. The lock portion 237, which is configured to engage with the perpendicular wall 126 of the ink cartridge 100 to lock the ink cartridge 100, is provided at the second end of the extending portion 238. The operation lever 234 protrudes toward the outside of the frame 204, i.e., toward a cover 250. The operation lever 234 has a flat plate shape. The rounded end 235 of the operation lever 234 has a semicircular shape in which a corner portion is rounded as viewed in a plan view.

The width of the lock arm 230 in the widthwise direction 21, in other words, the dimension of the lock arm 230 in a horizontal direction perpendicular to the insertion direction 30 is less than the width of the ink cartridge 100. Accordingly, the lock arm 230 is positioned within an area occupied by the ink cartridges 100 in the cartridge attaching section 202, in the widthwise direction 21. The lower surface of the lock portion 237 is curved at positions nearer to the second end of the extending portion 238.

When the operation lever 234 is pressed downwardly, a protruding strip 236 of the frame 204 (see FIG. 1), which is disposed below the operation lever 234, abuts against the lower surface of the lock arm 230 to restrict the range of rotation of the lock arm 230. On the other hand, an upper edge portion 205 (see FIG. 1) of the frame 204, which is disposed in the vicinity of the opening 207 of the frame 204, abuts against the upper surface of the lock arm 230 to restrict the range of rotation of the lock arm 230. In other words, the range of rotation of the lock arm 230 is limited by the upper edge portion 205 and the protruding strip 236 of the frame 204.

The coil spring 219 is provided between the lock arm 230 and the frame 204. A fastening portion 241, which protrudes in a hooked shape upwardly from the upper surface of the lock arm 230, is provided at the portion at which the extending portion 238 is connected to the connecting portion 240. The fastening portion 241 is provided to fasten one end of the coil spring 219. A fastening portion 239, which fastens the other end of the coil spring 219, protrudes in a horizontal direction at the upper surface of the frame 204. The four fastening portions 239 are provided at the frame 204 corresponding to the four lock arms 230. The coil spring 219 is stretched between the lock arm 230 and the frame 204, while the both ends are fastened by the fastening portions 239, 241 respectively. The coil spring 219 generates contraction force in the state that the coil spring 219 is stretched between the lock arm 230 and the frame 204. A rotational force, which is directed in the clockwise direction in FIG. 7 (direction of an arrow 245), is applied to the lock arm 230 by the contraction force of the coil spring 219.

When an external force is not applied to the operation lever 234, the lock arm 230 is retained in such a state that the lock arm 230 is urged in the direction of the arrow 245 by the coil spring 219 and the lock arm 230 abuts against the upper edge portion 205, which restricts the rotation. The attitude of the lock arm 230 in this state is referred to as "first attitude" in this specification. When the lock arm 230 has the first attitude, the operation lever 234 extends generally in a horizontal direction, and the lock portion 237 protrudes downwardly from the inner surface of a top wall of the frame 204 into the inside of the cartridge attaching section 202. When the lock arm 230 is positioned in the first attitude the lock portion 237 can abut against the ink cartridge 100 attached to the cartridge attaching section 202. Specifically, when the lock arm 230 is positioned in the first attitude, the lock portion 237 is configured to engage with the perpendicular surface of the perpendicular wall 126 of the stopper 125 of the ink cartridge 100 to restrict the movement of the ink cartridge 100 attached to the cartridge attaching section 202 in the pull-out direction 29. When the operation lever 234 is moved downwardly against the contraction force of the coil spring 219, the lock arm 230 is rotated in the direction opposite to the direction of the arrow 245, and the lock portion 237 is retracted from the inside of the cartridge attaching section 202. When the lock arm 230 has an attitude different from the first attitude as described above, the lock portion 237 is positioned at the position at which the lock portion 237 does not abut against the ink cartridge 100 attached to the cartridge attaching section 202. That is, when the lock arm 230 is in an attitude other than the first attitude, the lock portion 237 is positioned at the position at which the lock portion 237 is not engaged with the perpendicular surface of the perpendicular wall 126 of the stopper 125. When the lock arm 230 is further rotated, the lower surface of the lock arm 230 abuts against the protruding strip 236 of the frame 204 (see FIG. 1). The attitude of the lock arm 230 in this state is referred to as "second attitude" in this specification. That is, the lock arm 230 is capable of changing the attitude between the first attitude and the second attitude. The second attitude is an example of an attitude different from the first attitude. Therefore, when the lock arm 230 has the second attitude, the lock portion 237 is also positioned at the position at which the lock portion 237 does not abut against the ink cartridge 100 attached to the cartridge attaching section 202. That is, when the lock arm 230 has the second attitude, the lock portion 237 is positioned at the position at which the lock portion 237 is not engaged with the perpendicular surface of the perpendicular wall 126 of the stopper 125. When the lock arm 230 has an attitude different from the first attitude, the operation lever 234 is downwardly inclined, such that the rounded end 235, i.e., the second end of the operation lever 234 is positioned below the first end of the operation lever 234.

Figure 6:
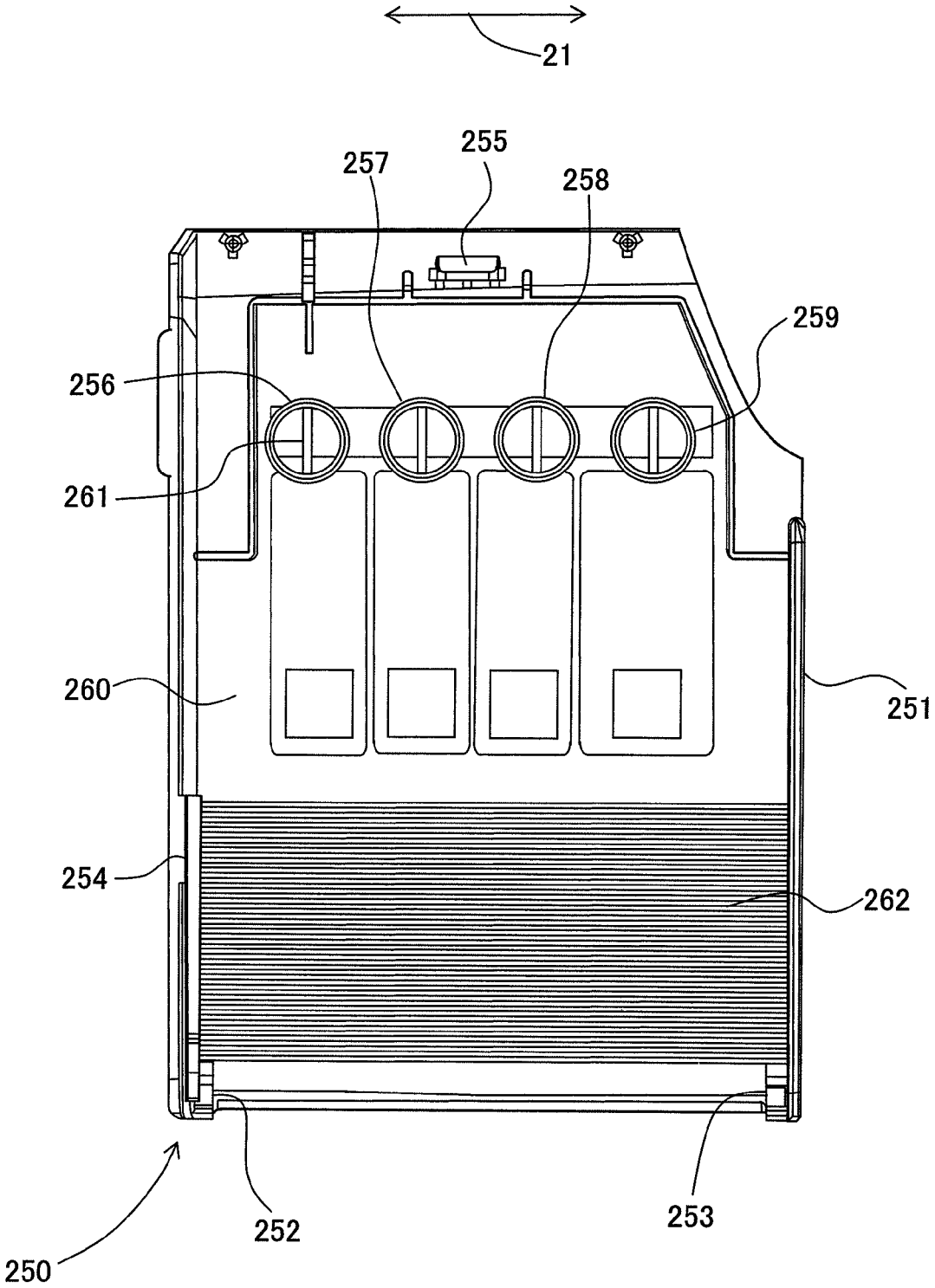
FIG. 6 is a front view of a cover of the ink supply apparatus of FIG. 1.

As shown in FIGS. 1 and 6, the cartridge attaching sections 202 comprises the cover 250 configured to selectively cover and close the opening 207 and uncover and open the opening 207. The cover 250 has a substantially flat plate-shaped cover body 251 which has a size to cover all of the four cartridge attaching sections 202 when the cover 250 is closed. Bearing portions 252, 253 protrude in the directions toward one another from the both sides of the cover body 251 at the lower end of the cover body 251. The bearing portions 252, 253 have cylindrical shapes to which bosses extending in the widthwise direction 21 can be fitted. Although not shown in the respective drawings, the bosses, which protrude in the mutually separating directions which is parallel with the widthwise direction 21, are provided at the lower end portions of the frame 204 in the vicinity of the opening 207 of the frame 204. The bosses are fitted to the bearing portions 252, 253, respectively. Accordingly, the cover body 251 is rotatable about the bosses as an axis. That is, the cover 250 and the frame 204 are assembled, such that the cover body 251 is rotatable in such manner that the upper end side of the cover body 251 rises and falls about the axis disposed on the lower end side of the cover body 251. Accordingly, the cover body 251 is configured selectively to have an open attitude in which the opening 207 is not covered by the cover body 251 and opened and a close attitude in which the opening 207 is covered by the cover body 251 and closed.

The cover 250 comprises a circular arc-shaped guide member 254 which extends from one side of the cover body 251 toward the frame 204. The guide member 254 has the circular arc-shaped form which extends along the direction of rotation of the cover body 251. Although not shown in the respective drawings, the distal end of the guide member 254 extends up to the side wall of the frame 204. A guide groove (not shown), which has the same circular arc-shaped form as that of the guide member 254, is formed in the side wall of the frame 204. A boss (not shown), which is provided at the distal end of the guide member 254, is inserted into and engaged with the guide groove. The range, in which the boss is movable in the guide groove, corresponds to the range of rotation of the cover body 251.

The cover 250 comprises a hook portion 255 provided in the vicinity of the upper end of the cover body 251. The hook portion 255 extends toward the frame 204 from an approximately central portion of the cover body 251 in the widthwise direction 21. Although not shown in the respective drawings, when the cover body 251 has the close attitude, then the hook portion 255 is engaged with a frame of the ink-consuming apparatus etc., and the cover body 251 is retained in the close attitude. When the hook portion 255 is elastically deformed, the engagement between the hook portion 255 and the frame of the ink-consuming apparatus is released, and the cover body 251 can move from the close attitude to the open attitude.

The cover 250 comprises cylindrical portions 256 to 259, as examples of closing-preventive members, are provided on the cover body 251 at positions opposed to the respective lock arms 230. The four lock arms 230 are arranged in the widthwise direction 21 corresponding to the four ink cartridges 100, respectively. The four cylindrical portions 256 to 259 are also arranged in the widthwise direction 21 corresponding to the lock arms 230, respectively. The respective cylindrical portions 256 to 259 are arranged at the positions at which the cylindrical portions 256 to 259 do not abut against the lock arms 230 which are in the first attitude but the cylindrical portions 256 to 259 abut against the lock arms 230 which are in an attitude other than the first attitude. The respective cylindrical portions 256 to 259 have the same shape except that the respective cylindrical portions 256 to 259 are arranged at different positions in the widthwise direction 21. Therefore, the structures of the cylindrical portions 256 to 259 will be explained in detail as exemplified by the cylindrical portion 256 by way of example.

The cylindrical portion 256 protrudes from a surface 260 of the cover body 251 opposed to the lock arm 230 in the insertion direction 30, when the ink cartridge 100 is attached to the cartridge attaching section 202 and the cover body 251 has the close attitude. The distal end of the cylindrical portion 256 is an open end. The size or dimension, in which the cylindrical portion 256 protrudes from the surface 260, is such a size or dimension that at least a portion of the cylindrical portion 256 is overlapped with the operation lever 234 of the lock arm 230 in the direction of the gravity, which is perpendicular to the insertion direction 30, when the cover body 251 has the close attitude and the lock arm 230 has the first attitude. In other words, when the lock arm 230 has the first attitude and the cover body 251 has the close attitude, the cylindrical portion 256 does not abut against the lock arm 230 but the rounded end 235 of the operation lever 234 of the lock arms 230 is overlapped with at least a portion of the cylindrical portion 256 in the direction perpendicular to the insertion direction30.

The inner diameter of the open end of the cylindrical portion 256 is slightly less than the diameter of the semicircular-shaped rounded end 235 of the operation lever 234 of the lock arm 230. Therefore, the rounded end 235 of the operation lever 234 can partially enter the inside of the cylindrical portion 256. However, the rounded end 235 of the operation lever 234 does not completely enter the inside of the cylindrical portion 256. When the rounded end 235 of the operation lever 234 partially enters the inside of the cylindrical portion 256, and the open end of the cylindrical portion 256 abuts against the edge of the rounded end 235, the rounded end 235 is guided toward the center of the cylindrical portion 256 with the aid of the circular shape of the open end of the cylindrical portion 256 and the semicircular shape of the rounded end 235. As a result, the rounded end 235 becomes such an attitude that the rounded end 235 cannot enter the cylindrical portion 256 any more, and the abutment state between the rounded end 235 and the cylindrical portion 256 is stabilized. The attitude of the lock arm 230 in this state, is referred to as "third attitude" in this specification.

More specifically, when the open end of the cylindrical portion 256 abuts against the edge of the rounded end 235 at the upper portion of the cylindrical portion 256, the lock arm 230 is guided toward the second attitude, and the lock arm 230 becomes the third attitude. When the open end of the cylindrical portion 256 abuts against the edge of the rounded end 235 at the lower portion of the cylindrical portion 256, the lock arm 230 is guided toward the first attitude, and the lock arm 230 becomes the third attitude.

In order to reinforce the strength of the cylindrical portion 256, a rib 261 which extends in the height direction 32 in a state that the cover body 251 has the close attitude, is provided in the internal space of the cylindrical portion 256. The rib 261 is disposed on the deep side as compared with the open end of the cylindrical portion 256, i.e., on the side of the surface 260. When the rounded end 235 of the operation lever 234 is brought in contact with the open end of the cylindrical portion 256, and the lock arm 230 becomes the third attitude, the rounded end 235 of the operation lever 234 abuts against the rib 261 as well. Although reference numerals are not affixed in the respective drawings, the same or equivalent ribs are also provided for the other cylindrical portions 257 to 259.

At least one, e.g., a plurality of ribs 262, as an example of an abutment portion, which extend in the widthwise direction 21, are provided at the surface 260 of the cover body 251 in the vicinity of the lower end of the cover body 251. The plurality of ribs 262 are arranged over a range extending from the vicinity of the bearing portions 252, 253 on the surface 260 up to the vicinity of the center of the surface 260 in the direction of the gravity when the cover body 251 has the close attitude. When the cover body 251 moves from the open attitude to the close attitude, the ribs 262 abut against the lower corner of the back surface 35 side of the ink cartridge 100, which is locked incompletely, as described later on, and the ink cartridge 100 is moved obliquely upwardly (in a direction between the insertion direction 30 and the upward direction in the direction of the gravity).

An explanation will be made below about the operation in which the ink cartridge 100 is attached to the cartridge attaching section 202. A part of the internal structure of the ink cartridge 100 is omitted from FIG. 7.

The lock arm 230 is maintained in the first attitude by the contraction force of the coil spring 219 when the ink cartridge 100 is not attached to the cartridge attaching section 202 and an external force is not applied to the operation lever 234 of the lock arm 230. When the lock arm 230 is in the first attitude, the upper surface of the operation lever 234 extends generally in a horizontal direction, and the lock portion 237 protrudes downwardly into the inner space of the frame 204. Therefore, when the ink cartridge 100 is inserted into the cartridge attaching section 202, a portion of the lock arm 230 which is disposed in the vicinity of the lock portion 237, may abut against the ink cartridge 100. The slider 41 of the ink cartridge 100 is at the first position by being elastically urged by the coil springs 48, 49 before the ink cartridge 100 is inserted into the cartridge attaching section 202.

When a user intends to attach the ink cartridge 100 to the cartridge attaching section 202, the cover body 251 is moved to have the open attitude, and the ink cartridge 100 is inserted from the opening 207 of the frame 204 into the cartridge attaching section 202. The insertion direction 30 of the ink cartridge 100 is parallel to a horizontal direction. The bottom surface of the ink cartridge 100 is inserted into the guide groove 206 formed in the frame 204. When the ink cartridge 100 is pushed and inserted into the cartridge attaching section 202, the ink cartridge 100 is linearly guided by the guide groove 206 to the inner end of the cartridge attaching section 202. The axial direction 151 of the seal member 93 of the ink cartridge 100 guided by the guide groove 206 is coincident with the axial direction 153 of the ink needle 209 of the cartridge attaching section 202.

The lock portion 237 of the lock arm 230 abuts against the upper wall 163 of the slider 41, as an example of a part of a guide portion. Accordingly, the lock arm 230 is moved in the direction opposite to direction indicated by the arrow 245, i.e., toward the second attitude against the contraction force of the coil spring 219. The lower surface of the lock portion 237 has the curved shape. Therefore, the lock portion 237 is smoothly moved onto the upper wall 163 of the slider 41, and the lock portion 237 is guided toward the stopper 125.

When the ink cartridge 100 is further pushed and inserted into the inner end of the cartridge attaching section 202, the front wall 161 of the slider 41 abuts against the surface of the inner end of the cartridge attaching section 202. When this occurs, the lock portion 237 is moved from the upper wall 163 of the slider 41 to the upper surface of the body cover 42, and the lock arm 230 is slightly moves back toward the first attitude.

When the slider 41 abuts against the surface of the inner end of the cartridge attaching section 202, and then the ink cartridge 100 is further pushed and inserted into the inner end of the cartridge attaching section 202, the coil springs 48, 49 contracts. The force to cause the coil springs 48, 49 to contract is a force with which the user pushes and inserts the ink cartridge 100. The slider 41 does not move relative to the cartridge attaching section 202 while abutting against the surface of the inner end of the cartridge attaching section 202. Therefore, the container body 40 and the body cover 42 are pushed and inserted into the cartridge attaching section 202 while moving relative to the slider 41. As a result, the slider 41, which has been at the first position, is made to slide to the second position. The coil springs 48, 49 are omitted from FIG. 7.

The container body 40 is moved, the rod 84 of the atmospheric air communication valve 80 abuts against the pressing portion 216, and the rod 84 is pushed against the urging force of the coil spring 86. The force to cause the coil spring 86 to contract is the force with which the user pushes and inserts the ink cartridge 100 into the cartridge attaching section 202. Accordingly, the valve element 87 is separated from the seal member 83, and the atmospheric air communication port 81 is opened. As a result, the air layer in the ink chamber 102 becomes the atmospheric pressure.

The container body 40 is moved, and the cap 95 of the ink supply valve 90 protrudes from the opening 178 of the slider 41, such that the cap 95 is fitted to the holding portion 210 of the joint 208. Further, the ink needle 209 is inserted into the ink supply port 91 against the urging force of the coil spring 96. Both of the axis 151 of the seal member 93 and the axis 153 of the ink needle 209 are coincident with the insertion direction 30. Therefore, when the ink cartridge 100 is inserted into the cartridge attaching section 202, the ink needle 209 is inserted into the inner hole of the seal member 93. A frictional force is caused when the ink needle 209 contacts and slides on the seal member 93 while the diameter of the inner hole of the seal member 93 is enlarged by the ink needle 209. The force to cause the coil spring 96 to contract against the frictional force is the force with which the user pushes and inserts the ink cartridge 100 into the cartridge attaching section 202. Accordingly, the ink supply valve 90 is connected to the joint 208. The ink contained in the ink chamber 102 may flow out to the outside of the ink cartridge 100 via the ink supply port 91 and the ink needle 209.

The container body 40 is moved, and the lock portion 237 of the lock arm 230 moves from the upper surface 36 of the body cover 42, and reaches the rib 127 of the container body 40, as an example of a part of a guide portion. The lock portion 237 of the lock arm 230 is then guided to the upper surface of the perpendicular wall 126. Accordingly, the lock arm 230 moves toward the second attitude. Subsequently, when the lock portion 237 of the lock arm 230 passes over the perpendicular wall 126 to reach the pedestal portion 124, the lock arm 230 moves in the direction of the arrow 245 back to the first attitude.

When the body cover 42 is pushed and inserted and the slider 41 moves to the second position, the user cannot push and insert the ink cartridge 100 any more into the cartridge attaching section 202. Accordingly, it is recognized that the ink cartridge 100 has been pushed and inserted into the cartridge attaching section 202 up to the insertion limit. When the user stops the pushing and insertion of the ink cartridge 100, the slider 41 intends to move from the second position to the first position by being urged by the coil springs 48, 49. In other words, the body cover 42 and the container body 40 intend to make the relative movement with respect to the slider 41 in the pull-out direction 29.

In the atmospheric air communication valve 80, the valve element 87 intends to move toward the seal member 83 by being urged by the coil spring 86. Similarly, in the ink supply valve 90, the valve element 97 intends to move toward the seal member 93 by being urged by the coil spring 96.

The container body 40 intends to move in the pull-out direction 29 by being urged by the respective coil springs 48, 49, 86, 96 described above. However, the lock portion 237 of the lock arm 230 in the first attitude is engaged with the perpendicular surface of the perpendicular wall 126, and thus the movement of the container body 40 in the pull-out direction 29 is restricted. Accordingly, the ink cartridge 100 is locked at a particular position in the cartridge attaching section 202 against the urging forces of the respective coil springs 48, 49, 86, 96.

When the ink cartridge 100 is completely attached to the cartridge attaching section 202, the cover 250 is closed. As shown in FIG. 7, the respective cylindrical portions 256 to 259 of the cover 250 are arranged at the positions at which the cylindrical portions 256 to 259 do not abut against the lock arms 230 in the first attitude. Therefore, the cover body 251 moves from the open attitude to the close attitude, and the opening 207 is covered by the cover body 251 and closed. The ink-consuming apparatus is operated in this state, and the inks contained in the ink cartridges 100 are consumed.

When a user intends to replace the ink cartridge 100, the cover body 251 in the close attitude is moved to the open attitude. Accordingly, the opening 207 of the cartridge attaching section 202 is exposed. In order to release the ink cartridge 100 from the locked state, the user pushes the operation lever 234 of the lock arm 230 downwardly. Accordingly, the lock arm 230 is rotated in the direction opposite to the direction indicated by the arrow 245 about the support shaft 232. The lock arm 230 moves from the first attitude to an attitude other than the first attitude. When the lock arm 230 has an attitude different from the first attitude, the lock portion 237 is separated from the pedestal portion 124, and the lock portion 237 is moved to a position above the perpendicular wall 126.

When the lock portion 237 is moved to a position above the perpendicular wall 126, the movement of the container body 40 in the pull-out direction 29 is not restricted. Therefore, the container body 40 is moved in the pull-out direction 29 by receiving the urging forces of the respective coil springs 48, 49, 86, 96 described above, and the slider 41 relatively slides from the second position to the first position.

The ink needle 209 comes out from the ink supply port 91, and the valve element 97 closes the ink supply port 91 in the ink supply valve 90 in accordance with the movement of the container body 40. Further, the cap 95 is disengaged from the holding portion 210 of the joint 208.

The axis 151 of the inner hole of the seal member 93 forming the ink supply port 91 and the axis 153 of the ink needle 209 are coincident with the pull-out direction 29 of the ink cartridge 100. Therefore, as the container body 40 is moved in the pull-out direction 29, the seal member 93 is moved in the pull-out direction 29 while contacting and sliding on the ink needle 209. Thus, the ink needle 209 completely comes out from the ink supply port 91.

When the container body 40 and the body cover 42 are relatively moved with respect to the slider 41 and the slider 41 moves to the first position, a part of the body cover 42 protrudes to the outside of the cartridge attaching section 202 from the opening 207 of the cartridge attaching section 202. The user pinches and holds a part of the ink cartridge 100 protruding from the cartridge attaching section 202, such that the ink cartridge 100 is pulled out from the cartridge attaching section 202. Accordingly, the ink cartridge 100 is detached from the cartridge attaching section 202.

Figure 8:
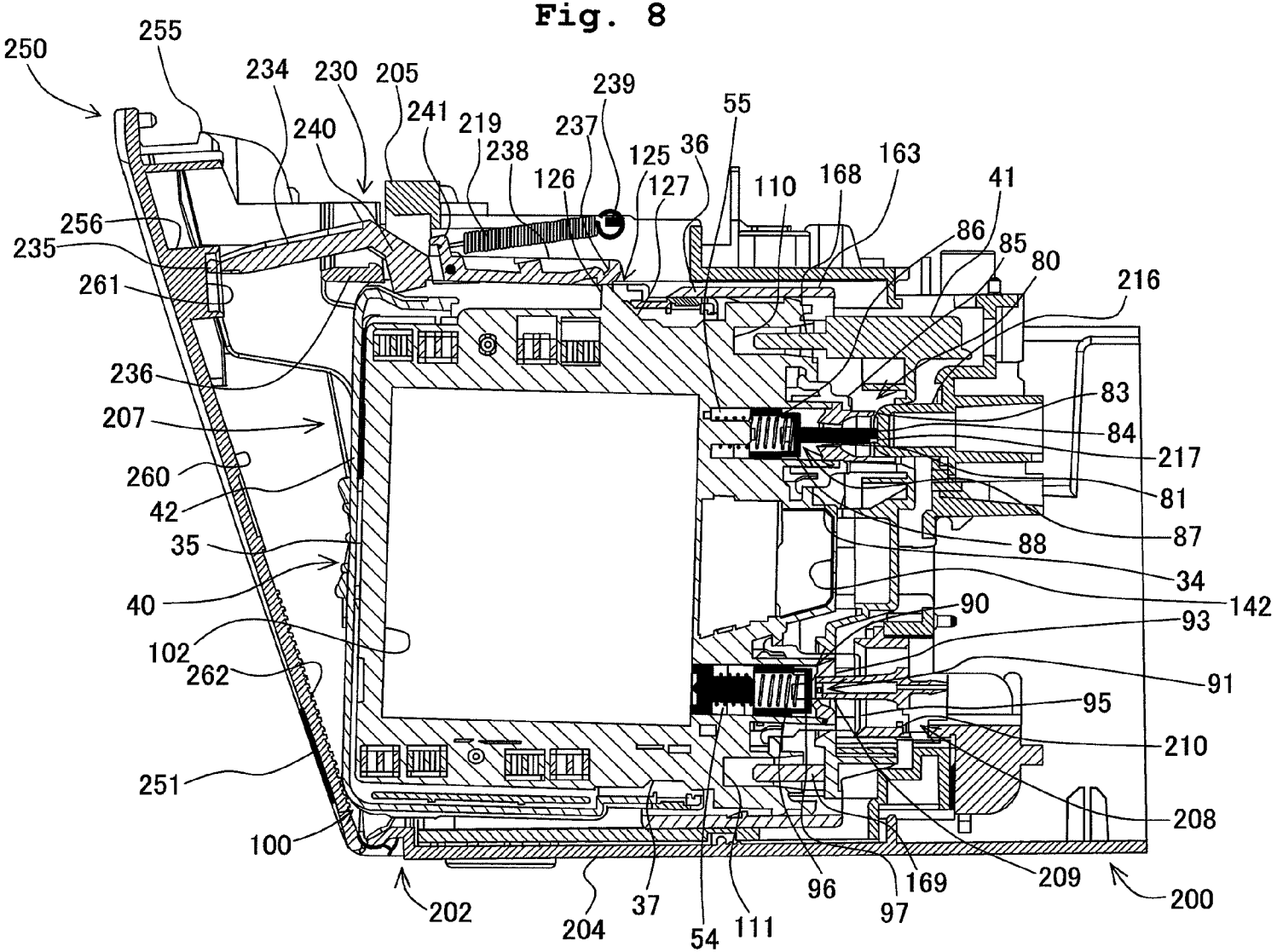
FIG. 8 is a cross-sectional view of the ink supply apparatus of FIG. 1, in which the ink cartridge of FIGS. 2A and 2B is locked incompletely.

An explanation will be made below about the operation in which the ink cartridge 100 is attached to the cartridge attaching section 202 incompletely. In FIG. 8, a part of the internal structure of the ink cartridge 100 is omitted.

Similarly to the above-described operation in which the ink cartridge 100 is attached to the cartridge attaching section 202 completely, the cover body 251 is moved to have the open attitude and the ink cartridge 100 is inserted from the opening 207 of the frame 204 into the cartridge attaching section 202

As shown in FIG. 8, the container body 40 is moved and the lock portion 237 of the lock arm 230 is guided onto the upper surface of the perpendicular wall 126 via the rib 127 of the container body 40 from the upper surface of the body cover 42. Accordingly, the attitude of the lock arm 230 is changed toward the second attitude. However, the following situation arises in some cases. That is, the lock portion 237 of the lock arm 230 is brought in contact under pressure with the upper surface of the perpendicular wall 126 due to the force to bring back the lock arm 230 to the first attitude and does not pass over the perpendicular wall 126. Accordingly, the ink cartridge 100 stays at this position against the urging force of each of the coil springs 48, 49, 86, 96. That is, the ink cartridge 100 is locked incompletely.

If a user misunderstand that the ink cartridge 100 has been pushed and inserted into the cartridge attaching section 202 up to the insertion limit when the ink cartridge is locked incompletely, and the user ceases to further push and insert the ink cartridge 100 into the cartridge attaching section 202, the ink needle 209 may not be completely inserted into the ink supply port 91 of the ink supply valve 90, and ink contained in the ink chamber 102 may not able to flow out to the outside.

If the cover body 251 is moved to the close attitude when the ink cartridge 100 is locked incompletely, the plurality of ribs 262, which are provided in the vicinity of the lower end of the surface 260 of the cover body 251, abut against the lower corner of the back surface side of the ink cartridge 100 when the cover body 251 moves from the open attitude to the close attitude, and the ink cartridge 100 is moved, such that the ink cartridge 100 is pushed and inserted obliquely upwardly. When this occurs, since the upper surface of the perpendicular wall 126 of the ink cartridge 100 is also moved obliquely upwardly, the lock portion 237 of the lock arm 230 which is brought in contact under pressure with the upper surface of the perpendicular wall 126 is moved obliquely upwardly as well. Accordingly, the attitude of the lock arm 230 is further changed toward the second attitude. At the same time or subsequently, the rounded end 235 of the operation lever 234 of the lock arm 230 in a attitude other than the first attitude abuts against the open end of the cylindrical portion 256. The rounded end 235 is guided toward the center of the cylindrical portion 256 with the aid of the circular shape of the open end of the cylindrical portion 256 and the semicircular shape of the rounded end 235. The abutment between the lock arm 230 and the cylindrical portion 256 is stabilized in the third attitude. Accordingly, the cover body 251 is prevented from having the close attitude. As described above, when the open end of the cylindrical portion 256 abuts against the edge of the rounded end 235 at the upper portion of the cylindrical portion 256, the lock arm 230 is guided toward the second attitude, and the lock arm 230 becomes the third attitude. When the open end of the cylindrical portion 256 abuts against the edge of the rounded end 235 at the lower portion of the cylindrical portion 256, the lock arm 230 is guided toward the first attitude, and the lock arm 230 becomes the third attitude.

According to this embodiment, when the ink cartridge 100 is not inserted up to the particular position in the cartridge attaching section 202, and the lock arm 230 has an attitude different from the first attitude, each of the cylindrical portions 256 to 259 abuts against one of the operation levers 234 during the process in which the cover body 251 moves toward the close attitude. Therefore, the cover body 251 is prevented from having the close attitude. Accordingly, the cover 250 is prevented from being closed when the ink cartridge 100 is incompletely attached to the cartridge attaching section 202.

When the cover 250 is not closed, a user recognizes that the attachment of the ink cartridge 100 to the cartridge attaching section 202 is incomplete, and the user may try to attach the ink cartridge 100 to the cartridge attaching section 202 again. Therefore, consumption of ink by the ink-consuming apparatus is suppressed when the attachment of the ink cartridge 100 is incomplete. When a sensor, which senses that the cover 250 is closed, is provided in the ink-consuming apparatus, and the ink-consuming apparatus is controlled, such that ink is not consumed unless the cover 250 is detected to be closed, the consumption of ink is prevented when the attachment of the ink cartridge 100 is incomplete.

When the lock arm 230 has an attitude different from the first attitude and when one of the upper portions of the cylindrical portions 256 to 259 abuts against one of the lock arms 230 during the process in which the cover body 251 moves toward the close attitude, the lock arm 230 is guided, such that the lock arm 230 moves toward the second attitude. Therefore, the lock arm 230 does not move back to the first attitude. Therefore, each of the cylindrical portions 256 to 259 reliably abuts against one of the lock arms 230 in an attitude other than the first attitude, and the cover body 251 is prevented from having the close attitude. Since some positional deviations of positions of the cylindrical portions 256 to 259 at the cover 250 and some positional deviations of a position at which the cover 250 is attached to the frame 204 are acceptable, it is easy to design, process, and assemble the cylindrical portions 256 to 259 and the cover 250.

When the lock arm 230 has an attitude other than the first attitude and when the upper portion of one of the cylindrical portions 256 to 259 abuts against one of the lock arms 230 during the process in which the cover body 251 moves toward the close attitude, the lock arm 230 is guided, such that the lock arm 230 moves toward the second attitude, and the lock arm 230 becomes the third attitude. When the lock arm 230 has an attitude other than the first attitude and when the lower portion of one of the cylindrical portions 256 to 259 abuts against one of the lock arms 230 during the process in which the cover body 251 moves toward the close attitude, the lock arm 230 is guided, such that the lock arm 230 moves toward the first attitude, and the lock arm 230 becomes the third attitude. Accordingly, the lock arm 230 does not move toward the first attitude or the second attitude from the third attitude by the abutment against one of the cylindrical portions 256 to 259. Therefore, the lock arm 230 reliably abuts against one of the cylindrical portions 256 to 259 in the third attitude, and the cover body 251 is prevented from having the close attitude.

It is temporarily assumed that the cylindrical portions 256 to 259 do not have the open ends but have planar flat surfaces, respectively, and each of the cylindrical portions 256 to 259 abuts against one of the rounded end 235 of the lock arm 230 on the planar flat surface. In this case, when the cover body 251 is further moved toward the close attitude after the rounded end 235 abuts against the planar flat surface of one of the cylindrical portions 256 to 259, rounded end 235 may slide on the planar flat surface toward the second attitude, and the rounded end 235 may be moved to a position below one of the cylindrical portions 256 to 259. It may be possible for the cover body 251 to have the close attitude when the rounded end 235 is in the position below one of the cylindrical portions 256 to 259 and the rounded end 235 does not abut against one of the cylindrical portions 256 to 259 any more. Nevertheless, according to this embodiment, such a possibility is reduced.

When the cover body 251 moves toward the close attitude in a state that the ink cartridge 100 is locked incompletely, the rib 262 of the cover 250 abuts against the ink cartridge 100, and the ink cartridge 100 is moved obliquely upwardly. Since the lock portion 237 of the lock arm 230 which is brought in contact under pressure with the upper surface of the perpendicular wall 126 of the ink cartridge 100 is also moved upwardly in accordance with this movement, the attitude of the lock arm 230 is further changed toward the second attitude. Thus, the attitude of the lock arm 230 becomes far from the first attitude and the rounded end 235 abuts against one of the cylindrical portions 256 to 259 of the cover 250. Therefore, the cover body 251 can be reliably prevented from having close attitude when the ink cartridge 100 is locked incompletely.

Figure 9:
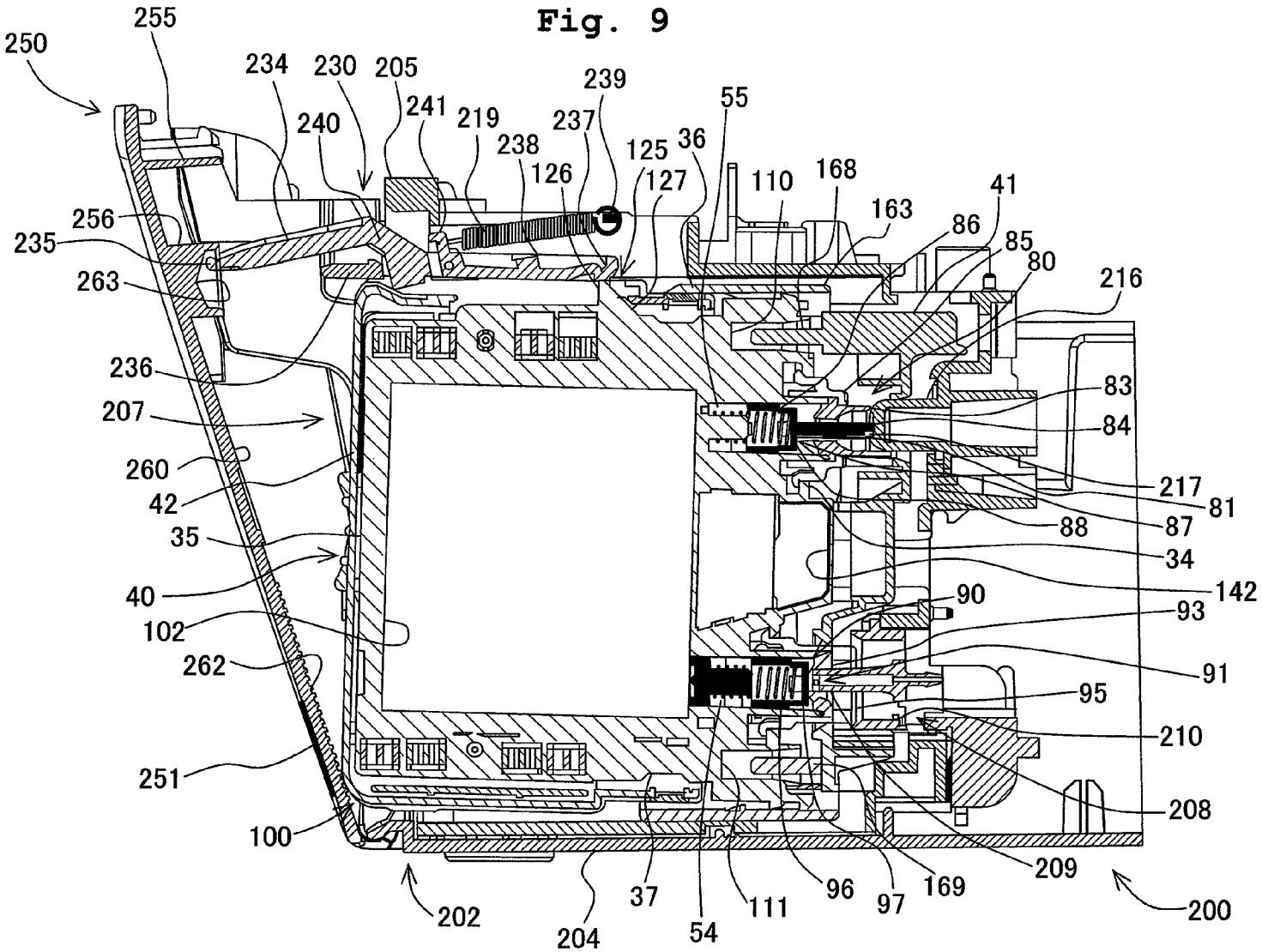
FIG. 9 is a cross-sectional view of an ink supply apparatus, in which the ink cartridge is locked incompletely in a modified embodiment.

In the embodiment described above, the rounded end 235 is guided toward the center of the cylindrical portion 256 with the aid of the circular shape of the open end of the cylindrical portion 256 and the semicircular shape of the rounded end 235, and the abutment State between the lock arm 230 and the cylindrical portion 256 is stabilized in the third attitude. However, the stabilization of the lock arm 230 as described above may be realized by other configurations. For example, in a modified embodiment as shown in FIG. 9, the end of a rib 263 provided in the internal space of the cylindrical portion 256, which is opposed to the operation lever 234, has a shape which is recessed toward the deep side of the cylindrical portion 256 at the central portion of the rib 263 in the height direction 32. The rounded end 235 of the operation lever 234 abuts against the end of the rib 263 without being brought in contact with the open end of the cylindrical portion 256. Accordingly, the rounded end 235 of the operation lever 234 is guided toward the center of the rib 263 in the height direction 32, and the abutment state between the lock arm 230 and the cylindrical portion 256 is stabilized in the third attitude. Moreover, when the rib 263 has the shape as described above, it is not necessary for the rib 263 to be provided in the internal space of the cylindrical portion 256. In other words, in another modified embodiment, the cylindrical portion 256 is not provided and only the rib 263 having the shape as described above may be provided on the surface 260 of the cover body 251, such that the rib 263 protrudes from the surface 260 of the cover body 251 in the insertion direction 30 when the cover body 251 has the close attitude.

The configuration, in which the plurality of ribs 262 abut against the lower corner of the back surface side of the ink cartridge 100 and thereby the ink cartridge 100 is moved, such that the ink cartridge 100 is pushed and inserted obliquely upwardly, may be omitted. Even when this configuration is absent, the lock arm 230 has an attitude other then the first attitude when the ink cartridge 100 is locked incompletely. Therefore, the rounded end 235 abuts against the cylindrical portion 256.

In the embodiment described above, the lock arm 230 is urged toward the first attitude by the coil spring 219 In another embodiment, the lock arm 230 may be designed, such the lock arm 230 is urged toward the first attitude by the gravity applied to the lock arm 230. For example, the extending portion 238 may be made to be heavier in weight than the operation lever 234, such that the lock arm 230 rotates toward the first attitude due to the weight of the extending portion 238.

In this embodiment, the cover 250 has the substantially flat plate-shaped cover body 251 which has a size to cover all of the four cartridge attaching sections 202 when the cover 250 is closed. However, the present invention is not limited to this, and, in another embodiment, the cover 250 may have four cover bodies 251, each of which has substantially a flat plate shape which has a size to cover one cartridge attaching section 202.

In the foregoing, an example in which the liquid supply apparatus of the present invention is applied to an ink-consuming apparatus such as an ink-jet printer in which ink is consumed. However, the liquid supply apparatus of the present invention is applicable not only to the ink-consuming apparatus but also to liquid-consuming apparatuses which are used in various fields such as medical treatment and analysis, provided that it is an apparatus which has the liquid supply apparatus of the present invention or is connected to the liquid supply apparatus of the present invention and consumes the liquid in the liquid container attached to the attaching section.

What is claimed is:

1. A liquid supply apparatus configured to supply a liquid for a liquid-consuming apparatus, comprising:

a liquid container comprising:

a storage chamber configured to store the liquid therein; and an engaging portion provided on an outer surface of the liquid container; and an attaching section to which the liquid container is attachable, which is formed with an opening through which the liquid container is configured to be inserted into the attaching section in an insertion direction, wherein the attaching section comprises:

a holding member configured to have an attitude which is changable between a first attitude and a second attitude, wherein the holding member is urged toward the first attitude, and wherein the holding member is configured to engage with the engaging portion of the liquid container to hold the liquid container at a particular position when the holding member has the first attitude, and the holding member is configured not to engage with the engaging portion of the liquid container when the holding member has the second attitude;

a cover configured to selectively have an open attitude and a close attitude, wherein the opening is not covered by the cover and opened when the cover has the open attitude, and the opening is covered by the cover and closed when the cover has the close attitude; and a closing-preventive member provided on the cover and configured such that, when the cover moves toward the close attitude, the closing-preventive member does not abut against the holding member having the first attitude and abuts against the holding member having an attitude different from the first attitude and thereby preventing the cover from having the close attitude, wherein the closing-preventive member has a shape configured to guide the holding member having the attitude different from the first attitude to move toward the second attitude.

2. The liquid supply apparatus according to claim 1, wherein when the cover has the close attitude, the closing-preventive member protrudes from the cover in the insertion direction.

3. The liquid supply apparatus according to claim 2, wherein the holding member comprises a connecting portion, a first extending portion extending from the connecting portion into an inside of the attaching section in a first direction, and a second extending portion extending from the connecting portion toward an outside of the attaching section in a second direction which is non-parallel with the first direction.

4. The liquid supply apparatus according to claim 3, wherein the second extending portion has a first end connected to the connecting portion and a second end opposite the first end, and wherein when the holding member has the first attitude, the second extending portion extends in a horizontal direction, and when the holding member has the second attitude, the second extending portion is downwardly inclined, such that the second end of the second extending portion is positioned below the first end of the second extending portion.

5. The liquid supply apparatus according to claim 4, wherein the holding member further comprises a lock portion configured to engage with the engaging portion of the liquid container, and wherein the first extending portion has a first end connected to the connecting portion and a second end opposite the first end, and the lock portion is located at the second end of the first extending portion.

6. The liquid supply apparatus according to claim 1, wherein the liquid container further comprises a guide portion configured to change the attitude of the holding member toward the second attitude and guide the holding member to the engaging portion until the liquid container reaches the particular position, and wherein the cover further comprises an abutment portion configured, when the cover moves toward the close attitude, to abut against the liquid container which is not in the particular position, such that the liquid container moves to further change the attitude of the holding member toward the second attitude.

7. A liquid-consuming apparatus configured to consume a liquid, comprising:

a liquid jetting apparatus configured to jet the liquid; and the liquid supply apparatus as defined in claim 1, which is connected to the liquid jetting apparatus to supply the liquid to the liquid jetting apparatus.

8. A liquid supply apparatus configured to supply a liquid for a liquid-consuming apparatus, comprising:

a liquid container comprising:

a storage chamber configured to store the liquid therein; and an engaging portion provided on an outer surface of the liquid container; and an attaching section to which the liquid container is attachable, which is formed with an opening through which the liquid container is configured to be inserted into the attaching section in an insertion direction, wherein the attaching section comprises:

a holding member configured to have an attitude which is changable between a first attitude and a second attitude, wherein the holding member is urged toward the first attitude, and wherein the holding member is configured to engage with the engaging portion of the liquid container to hold the liquid container at a particular position when the holding member has the first attitude, and the holding member is configured not to engage with the engaging portion of the liquid container when the holding member has the second attitude;

a cover configured to selectively have an open attitude and a close attitude, wherein the opening is not covered by the cover and opened when the cover has the open attitude, and the opening is covered by the cover and closed when the cover has the close attitude; and a closing-preventive member provided on the cover and configured such that, when the cover moves toward the close attitude, the closing-preventive member does not abut against the holding member having the first attitude and abuts against the holding member having an attitude different from the first attitude and thereby preventing the cover from having the close attitude, wherein when the cover has the close attitude, the closing preventive member protrudes from the cover in the insertion direction, wherein the holding member comprises a lever which extends toward the cover having the close attitude, and the lever has a flat plate shape having a rounded end, and wherein the closing-preventive member has a cylindrical shape having an open end configured to abut against the rounded end of the holding member.

9. The liquid supply apparatus according to claim 8, wherein the closing-preventive member has a shape configured to guide the holding member having the attitude different from the first attitude to move to a third attitude which is between the first attitude and the second attitude.

10. The liquid supply apparatus according to claim 8, wherein the rounded end of the holding member is semicircular-shaped and an inner diameter of the open end of the closing-preventive member is less than a diameter of the rounded end.

11. The liquid supply apparatus according to claim 8, wherein when the holding member has the first attitude and the cover has the close attitude, the rounded end of the holding member is overlapped with at least a portion of the closing-preventive member in a direction perpendicular to the insertion direction.

12. A liquid supply apparatus configured to supply a liquid for a liquid-consuming apparatus, comprising:

a liquid container comprising:

a storage chamber configured to store the liquid therein; and an engaging portion provided on an outer surface of the liquid container; and an attaching section to which the liquid container is attachable, which is formed with an opening through which the liquid container is configured to be inserted into the attaching section in an insertion direction, wherein the attaching section comprises:

a holding member configured to have an attitude which is changable between a first attitude and a second attitude, wherein the holding member is urged toward the first attitude, and wherein the holding member is configured to engage with the engaging portion of the liquid container to hold the liquid container at a particular position when the holding member has the first attitude, and the holding member is configured not to engage with the engaging portion of the liquid container when the holding member has the second attitude;

a cover configured to selectively have an open attitude and a close attitude, wherein the opening is not covered by the cover and opened when the cover has the open attitude, and the opening is covered by the cover and closed when the cover has the close attitude; and a closing-preventive member provided on the cover and configured such that, when the cover moves toward the close attitude, the closing-preventive member does not abut against the holding member having the first attitude and abuts against the holding member having an attitude different from the first attitude and thereby preventing the cover from having the close attitude, wherein the liquid container further comprises a guide portion configured to change the attitude of the holding member toward the second attitude and guide the holding member to the engaging portion until the liquid container reaches the particular position, and wherein the cover further comprises an abutment portion configured, when the cover moves toward the close attitude, to abut against the liquid container which is not in the particular position, such that the liquid container moves to further change the attitude of the holding member toward the second attitude.

* * * * *